US010934704B2

(12) United States Patent
Witherspoon et al.

(10) Patent No.: US 10,934,704 B2
(45) **Date of Patent: *Mar. 2, 2021**

(54) FIRE AND/OR WATER RESISTANT EXPANSION JOINT SYSTEM

(71) Applicant: Emseal Joint Systems Ltd., Westborough, MA (US)

(72) Inventors: Bill Witherspoon, Guelph (CA); Lester Hensley, Westborough, MA (US)

(73) Assignee: EMSEAL JOINT SYSTEMS LTD., Westborough, MA (US)

( * ) Notice: Subject to any disclaimer, the term of this patent is extended or adjusted under 35 U.S.C. 154(b) by 46 days.

This patent is subject to a terminal disclaimer.

(21) Appl. No.: 15/613,936

(22) Filed: Jun. 5, 2017

(65) Prior Publication Data

US 2017/0268222 A1 Sep. 21, 2017

Related U.S. Application Data

(63) Continuation of application No. 13/729,500, filed on Dec. 28, 2012, now Pat. No. 9,670,666, which is a (Continued)

(51) Int. Cl.
*E04B 1/68* (2006.01)
*E04B 1/94* (2006.01)
(Continued)

(52) U.S. Cl.
CPC ..... *E04B 1/948* (2013.01); *E04B 1/68* (2013.01); *E04B 1/6806* (2013.01);
(Continued)

(58) Field of Classification Search
CPC ..... C09K 21/00; E04B 1/66; E04B 1/6801; E04B 1/6803; E04B 1/6804; E04B 1/94;
(Continued)

(56) References Cited

U.S. PATENT DOCUMENTS 517,701 A 4/1894 Knower
945,914 A 4/1909 Colwell
(Continued)

FOREIGN PATENT DOCUMENTS

CA 1280007 4/1989
CA 1334268 8/1989
(Continued)

OTHER PUBLICATIONS

Iso-Chemie, ISO BLOCO 600 solukumitiiviste, Finnish language, pp. 1-2; publication date unknown from document.
(Continued)

*Primary Examiner* — William V Gilbert
(74) *Attorney, Agent, or Firm* — MKG, LLC

(57) ABSTRACT

An expansion joint system comprises a core; and a fire retardant included in the core in an amount effective to pass testing mandated by UL 2079. The core with the fire retardant is configured to facilitate compression of the expansion joint system when installed between substrates by repeatedly expanding and contracting to accommodate movement of the substrates; and the core with the fire retardant included therein is configured to pass the testing mandated by UL 2079.

55 Claims, 5 Drawing Sheets

Related U.S. Application Data continuation-in-part of application No. 12/622,574, filed on Nov. 20, 2009, now Pat. No. 8,365,495.

(60) Provisional application No. 61/116,453, filed on Nov. 20, 2008.

(51) Int. Cl.
*E04B 1/98* (2006.01)
*E04C 2/20* (2006.01)

(52) U.S. Cl.
CPC ..... *E04B 1/6812* (2013.01); *E04B 1/944* (2013.01); *E04B 1/98* (2013.01); *E04C 2/205* (2013.01)

(58) Field of Classification Search
CPC . E04B 1/941; E04B 1/947; E04B 1/98; E04B 1/6806; E04B 1/6812; E04B 1/944; E04B 1/948; B29C 43/02; E04C 2/205; F16J 15/022; F16J 15/065
USPC .... 52/395, 396.01, 465, 466, 467, 468, 232, 52/317, 393, 396.03, 396.04, 396.07, 52/396.06, 586.1, 586.2, 39, 6.04; 404/47, 48
See application file for complete search history.

(56) References Cited

U.S. PATENT DOCUMENTS 1,357,713 A 11/1920 Lane
1,371,727 A 3/1921 Blickle
1,428,881 A 9/1922 Dyar
1,691,402 A 11/1928 Oden
1,716,994 A 6/1929 Wehrle
1,809,613 A 6/1931 Walker
2,010,569 A 8/1935 Sitzler
2,016,858 A 10/1935 Hall
2,035,476 A 3/1936 Herwood
2,152,189 A 4/1936 Henderson
2,069,899 A 2/1937 Older
2,190,532 A 2/1940 Lukomski
2,240,787 A 5/1941 Kinzer
2,271,180 A 1/1942 Brugger
2,277,286 A 3/1943 Bechtner
2,544,532 A 3/1951 Hill
2,701,155 A 2/1955 Estel, Jr.
2,776,865 A 1/1957 Anderson
2,828,235 A 3/1958 Holland et al.
2,954,592 A 10/1960 Parsons
2,995,056 A 10/1960 Knox
3,024,504 A 3/1962 Miller
3,080,540 A 3/1963 McFarland
3,111,069 A 11/1963 Farbish
3,124,047 A 3/1964 Graham
3,172,237 A 3/1965 Bradley
3,194,846 A 7/1965 Blaga
3,232,786 A 2/1966 Kellman
3,244,130 A 4/1966 Hipple, Jr.
3,245,328 A 4/1966 Fassbinder
3,255,680 A 6/1966 Cooper et al.
3,262,894 A 7/1966 Green
3,289,374 A 12/1966 Metz
3,298,653 A 1/1967 Omholt
3,300,913 A 1/1967 Patry et al.
3,302,690 A 2/1967 Hurd
3,335,647 A 8/1967 Thorp, Jr.
3,344,011 A 9/1967 Goozner
3,352,217 A 11/1967 Peters et al.
3,355,846 A 12/1967 Tillson
3,363,383 A 1/1968 Barge
3,371,456 A 3/1968 Balzer et al.
3,372,521 A 3/1968 Thom
3,378,958 A 4/1968 Parks et al.
3,394,639 A 7/1968 Viehmann
3,410,037 A 11/1968 Empson et al.
3,435,574 A 4/1969 Hallock
3,447,430 A 6/1969 Gausepohl
3,470,662 A 10/1969 Kellman
3,482,492 A 12/1969 Bowman
3,543,459 A 12/1970 Mills
3,551,009 A 12/1970 Cammuso et al.
3,575,372 A 4/1971 Emberson
3,582,095 A 6/1971 Bogaert et al.
3,603,048 A 9/1971 Hadfield
3,604,322 A 9/1971 Koster
3,606,826 A 9/1971 Bowman
3,629,986 A 12/1971 Klittich
3,643,388 A 2/1972 Parr et al.
3,659,390 A 5/1972 Balzer et al.
3,670,470 A 6/1972 Thom
3,672,707 A 6/1972 Russo et al.
3,677,145 A 7/1972 Wattiez
3,694,976 A 10/1972 Warshaw
3,712,188 A 1/1973 Worson
3,720,142 A 3/1973 Pare
3,724,155 A 4/1973 Reeve
3,736,713 A 6/1973 Flachbarth et al.
3,742,669 A 7/1973 Mansfeld
3,745,726 A 7/1973 Thom
3,750,359 A 8/1973 Balzer et al.
3,760,544 A 9/1973 Hawes et al.
3,797,188 A 3/1974 Mansfeld
3,849,958 A 11/1974 Balzer et al.
3,856,839 A 12/1974 Smith et al.
3,871,787 A 3/1975 Stegmeier
3,880,539 A 4/1975 Brown
3,883,475 A 5/1975 Racky et al.
3,896,511 A 7/1975 Cuschera
3,907,443 A 9/1975 McLean
3,911,635 A 10/1975 Traupe
3,934,905 A 1/1976 Lockard
3,944,704 A 3/1976 Dirks
3,951,562 A 4/1976 Fyfe
3,956,557 A 5/1976 Hurst
3,974,609 A 8/1976 Attaway
4,007,994 A 2/1977 Brown
4,018,017 A 4/1977 Schoop
4,018,539 A 4/1977 Puccio
4,022,538 A 5/1977 Watson et al.
4,030,156 A 6/1977 Raymond
4,055,925 A 11/1977 Wasserman et al.
4,058,947 A † 11/1977 Earle
4,066,578 A 1/1978 Murch et al.
4,129,967 A 12/1978 Barlow
4,132,491 A 1/1979 Scheffel
4,134,875 A 1/1979 Tapia
4,140,419 A 2/1979 Puccio
4,143,088 A 3/1979 Favre et al.
4,146,939 A 4/1979 Izzi
4,174,420 A 11/1979 Anolick et al.
4,181,711 A 1/1980 Ohashi et al.
4,204,856 A 5/1980 Yigdall et al.
4,216,261 A 8/1980 Dias
4,221,502 A 9/1980 Tanikawa
4,224,374 A 9/1980 Priest
4,237,182 A 12/1980 Fulmer et al.
4,245,925 A 1/1981 Pyle
4,246,313 A 1/1981 Stengle, Jr.
4,258,606 A 3/1981 Wilson
4,270,318 A 6/1981 Carroll et al.
4,271,650 A 6/1981 Lynn-Jones
4,288,559 A † 9/1981 Illger
4,290,249 A 9/1981 Mass
4,290,713 A 9/1981 Brown et al.
4,295,311 A 10/1981 Dahlberg
4,305,680 A 12/1981 Rauchfuss, Jr.
4,320,611 A 3/1982 Freeman
4,359,847 A 11/1982 Schukolinski
4,362,428 A 12/1982 Kerschner
4,367,976 A 1/1983 Bowman
4,374,207 A 2/1983 Stone et al.
4,374,442 A 2/1983 Hein et al.
4,401,716 A 8/1983 Tschudin-Mahrer

(56) References Cited

U.S. PATENT DOCUMENTS 4,424,956 A 1/1984 Grant et al.
4,431,691 A 2/1984 Greenlee
4,432,465 A 2/1984 Wuertz
4,433,732 A 2/1984 Licht et al.
4,447,172 A 5/1984 Galbreath
4,453,360 A 6/1984 Barenberg
4,455,396 A 6/1984 Al-Tabaqchall et al.
4,473,015 A 9/1984 Hounsel
4,486,994 A 12/1984 Fisher et al.
4,494,762 A 1/1985 Geipel
4,533,278 A 8/1985 Corsover et al.
4,558,875 A 12/1985 Yamaji et al.
4,564,550 A 1/1986 Tschudin-Mahrer
4,566,242 A 1/1986 Dunsworth
4,576,841 A 3/1986 Lingemann
4,589,242 A 5/1986 Moulinie et al.
4,615,411 A 10/1986 Breitscheidel et al.
4,620,330 A 11/1986 Izzi, Sr.
4,620,407 A 11/1986 Schmid
4,622,251 A 11/1986 Gibb
4,637,085 A 1/1987 Hartkorn
4,687,829 A 8/1987 Chaffee et al.
4,693,652 A 9/1987 Sweeney
4,711,928 A 12/1987 Lee et al.
4,717,050 A 1/1988 Wright
4,745,711 A 5/1988 Box
4,751,024 A 6/1988 Shu et al.
4,756,945 A 7/1988 Gibb
4,767,655 A 8/1988 Tschudin-Mahrer
4,773,791 A 9/1988 Hartkorn
4,780,571 A 10/1988 Huang
4,781,003 A 11/1988 Rizza
4,784,516 A 11/1988 Cox
4,791,773 A 12/1988 Taylor
4,807,843 A 2/1989 Courtois et al.
4,815,247 A 3/1989 Nicholas
4,824,283 A 4/1989 Belangie
4,835,130 A 5/1989 Box
4,839,223 A 6/1989 Tschudin-Mahrer
4,848,044 A 7/1989 LaRoche et al.
4,849,223 A 7/1989 Pratt et al.
4,866,898 A 9/1989 LaRoche et al.
4,879,771 A 11/1989 Piskula
4,882,890 A 11/1989 Rizza
4,885,885 A 12/1989 Gottschling
4,893,448 A 1/1990 McCormick
4,901,488 A 2/1990 Murota et al.
4,911,585 A 3/1990 Vidal et al.
4,916,878 A 4/1990 Nicholas
4,920,725 A 5/1990 Gore
4,927,291 A 5/1990 Belangie
4,932,183 A 6/1990 Coulston
4,942,710 A 7/1990 Rumsey
4,952,615 A 8/1990 Welna
4,957,798 A 9/1990 Bogdany
4,965,976 A 10/1990 Riddle et al.
4,977,018 A 12/1990 Irrgeher et al.
4,992,481 A 2/1991 von Bonin et al.
5,007,765 A 4/1991 Dietlein et al.
5,013,377 A 5/1991 Lafond
5,024,554 A 6/1991 Benneyworth et al.
5,026,609 A 6/1991 Jacob et al.
5,035,097 A 7/1991 Cornwall
5,053,442 A 10/1991 Chu et al.
5,060,439 A 10/1991 Clements et al.
5,071,282 A 12/1991 Brown
5,072,557 A 12/1991 Naka et al.
5,082,394 A 1/1992 George
5,094,057 A 3/1992 Morris
5,115,603 A 5/1992 Blair
5,120,584 A 6/1992 Ohlenforst et al.
5,121,579 A 6/1992 Hamar et al.
5,129,754 A 7/1992 Brower
5,130,176 A 7/1992 Baerveldt
5,137,937 A 8/1992 Huggard et al.
5,140,797 A 8/1992 Gohike et al.
5,168,683 A 12/1992 Sansom et al.
5,173,515 A 12/1992 von Bonin et al.
5,190,395 A 3/1993 Cathey et al.
5,209,034 A 5/1993 Box et al.
5,213,441 A 5/1993 Baerveldt
5,222,339 A 6/1993 Hendrickson et al.
5,249,404 A 10/1993 Leek et al.
5,270,091 A 12/1993 Krysiak et al.
5,297,372 A 3/1994 Nicholas
5,327,693 A 7/1994 Schmid
5,335,466 A 8/1994 Langohr
5,338,130 A 8/1994 Baerveldt
5,354,072 A 10/1994 Nicholson
5,365,713 A 11/1994 Nicholas et al.
5,367,850 A 11/1994 Nicholas
5,380,116 A 1/1995 Colonias
5,436,040 A 7/1995 Lafond
5,441,779 A 8/1995 Lafond
5,443,871 A 8/1995 Lafond
5,450,806 A 9/1995 Jean
5,456,050 A 10/1995 Ward
5,472,558 A 12/1995 Lafond
5,479,745 A 1/1996 Kawai et al.
5,485,710 A 1/1996 Lafond
5,489,164 A 2/1996 Tusch et al.
5,491,953 A 2/1996 Lafond
5,498,451 A 3/1996 Lafond
5,501,045 A 3/1996 Wexler
5,508,321 A 4/1996 Brebner
5,528,867 A 6/1996 Thompson
RE35,291 E 7/1996 Lafond
5,572,920 A 11/1996 Kennedy et al.
5,607,253 A 3/1997 Almstrom
5,611,181 A 3/1997 Shreiner et al.
5,616,415 A 4/1997 Lafond
5,628,857 A 5/1997 Baerveldt
5,635,019 A 6/1997 Lafond
5,649,784 A 7/1997 Ricaud et al.
5,650,029 A 7/1997 Lafond
5,656,358 A 8/1997 Lafond
5,658,645 A 8/1997 Lafond
5,664,906 A 9/1997 Baker et al.
5,680,738 A 10/1997 Allen et al.
5,686,174 A 11/1997 Irrgeher
5,691,045 A 11/1997 Lafond
5,744,199 A † 4/1998 Joffre
5,759,665 A 6/1998 Lafond
5,762,738 A 6/1998 Lafond
5,765,332 A † 6/1998 Landin
5,773,135 A 6/1998 Lafond
5,791,111 A 8/1998 Beenders
5,806,272 A 9/1998 Lafond
5,813,191 A 9/1998 Gallagher
5,830,319 A 11/1998 Landin
5,851,609 A 12/1998 Baratuci et al.
5,875,598 A 3/1999 Batten et al.
5,876,554 A 3/1999 Lafond
5,878,448 A 3/1999 Molter
5,887,400 A 3/1999 Bratek et al.
5,888,341 A 3/1999 Lafond
5,935,695 A 8/1999 Baerveldt
5,957,619 A 9/1999 Kinoshita et al.
5,974,750 A 11/1999 Landin et al.
5,975,181 A 11/1999 Lafond
6,001,453 A 12/1999 Lafond
6,014,848 A 1/2000 Hillburn, Jr.
6,035,536 A 3/2000 Dewberry
6,035,587 A 3/2000 Dressler
6,035,602 A 3/2000 Lafond
6,039,503 A 3/2000 Cathey
D422,884 S 4/2000 Lafond
6,088,972 A 6/2000 Johanneck
6,102,407 A 8/2000 Moriya et al.
6,115,980 A 9/2000 Knak et al.
6,115,989 A 9/2000 Boone et al.
6,128,874 A 10/2000 Olson et al.
6,131,352 A 10/2000 Barnes et al.
6,131,364 A 10/2000 Peterson

(56) References Cited

U.S. PATENT DOCUMENTS 6,131,368 A 10/2000 Tramposch et al.
6,138,427 A 10/2000 Houghton
6,148,890 A 11/2000 Lafond
6,158,915 A 12/2000 Kise
6,189,573 B1 2/2001 Ziehm
6,192,652 B1 2/2001 Goer et al.
6,207,085 B1 3/2001 Ackerman
6,207,089 B1 3/2001 Chuang
6,219,982 B1 4/2001 Eyring
6,237,303 B1 5/2001 Allen et al.
6,250,358 B1 6/2001 Lafond
6,253,514 B1 7/2001 Jobe et al.
6,329,030 B1 12/2001 Lafond
6,350,373 B1 2/2002 Sondrup
6,351,923 B1 3/2002 Peterson
6,355,328 B1 3/2002 Baratuci et al.
6,368,670 B1 4/2002 Frost et al.
6,419,237 B1 7/2002 More
6,439,817 B1 8/2002 Reed
6,443,495 B1 9/2002 Harmeling
6,460,214 B1 10/2002 Chang
6,491,468 B1 12/2002 Hagen
6,499,265 B2 12/2002 Shreiner
6,532,708 B1 3/2003 Baerveldt
6,544,445 B1 4/2003 Graf et al.
6,552,098 B1 4/2003 Bosch et al.
6,574,930 B2 6/2003 Kiser
6,581,341 B1 6/2003 Baratuci et al.
6,598,634 B1 7/2003 Pelles
6,665,995 B2 12/2003 Deane
6,666,618 B1 12/2003 Anaya et al.
6,685,196 B1 2/2004 Baerveldt
6,820,382 B1 11/2004 Chambers et al.
6,860,074 B2 3/2005 Stanchfield
6,862,863 B2 3/2005 McCorkle et al.
6,877,292 B2 4/2005 Baratuci et al.
6,897,169 B2 5/2005 Matsui et al.
6,905,650 B2 6/2005 McIntosh et al.
6,948,287 B2 9/2005 Korn
6,989,188 B2 1/2006 Brunnhofer et al.
6,996,944 B2 2/2006 Shaw
7,043,880 B2 5/2006 Morgan et al.
7,070,653 B2 7/2006 Frost et al.
7,090,224 B2 8/2006 Iguchi et al.
7,101,614 B2 9/2006 Anton et al.
7,114,899 B2 10/2006 Gass et al.
7,210,557 B2 5/2007 Phillips et al.
7,222,460 B2 5/2007 Francies, III et al.
7,225,824 B2 6/2007 West et al.
7,240,905 B1 7/2007 Stahl, Sr.
7,278,450 B1 10/2007 Condon
7,287,738 B2 10/2007 Pitlor
7,441,375 B2 10/2008 Lang
7,621,731 B2 11/2009 Armantrout et al.
7,665,272 B2 2/2010 Reen
7,678,453 B2 3/2010 Ohnstad et al.
7,748,310 B2 7/2010 Kennedy
7,757,450 B2 7/2010 Reyes et al.
7,836,659 B1 11/2010 Barnes
7,856,781 B2 12/2010 Hillburn, Jr.
7,877,958 B2 2/2011 Baratuci et al.
7,941,981 B2 5/2011 Shaw
8,033,073 B1 10/2011 Binder
8,079,190 B2 12/2011 Hillburn, Jr.
8,171,590 B2 5/2012 Kim
8,172,938 B2 5/2012 Alright et al.
8,317,444 B1 11/2012 Hensley
8,333,532 B2 12/2012 Derrigan et al.
8,341,908 B1 1/2013 Hensley et al.
8,365,495 B1 * 2/2013 Witherspoon ..... E04B 1/948 52/741.3
8,397,453 B2 3/2013 Shaw
8,601,760 B2 12/2013 Hilburn, Jr.
8,720,138 B2 5/2014 Hilburn, Jr.
8,739,495 B1 6/2014 Witherspoon
8,813,449 B1 8/2014 Hensley et al.
8,813,450 B1 8/2014 Hensley et al.
9,068,297 B2 6/2015 Hensley et al.
9,200,437 B1 12/2015 Hensley et al.
9,689,158 B1 * 6/2017 Hensley ..... E04B 1/6804
10,179,993 B2 * 1/2019 Hensley ..... E04B 1/948
2002/0052425 A1 5/2002 Kaku et al.
2002/0088192 A1 7/2002 Calixto
2002/0095908 A1 7/2002 Kiser
2002/0113143 A1 8/2002 Frost et al.
2002/0193552 A1 12/2002 Kiuchi et al.
2003/0005657 A1 1/2003 Visser et al.
2003/0110723 A1 6/2003 Baerveldt
2003/0213211 A1 11/2003 Morgan et al.
2004/0020162 A1 2/2004 Baratuci et al.
2004/0024077 A1 2/2004 Braun et al.
2004/0045234 A1 3/2004 Morgan et al.
2004/0101672 A1 5/2004 Anton et al.
2004/0113390 A1 6/2004 Broussard, III
2004/0163724 A1 8/2004 Trabbold et al.
2005/0005553 A1 1/2005 Baerveldt
2005/0066600 A1 3/2005 Moulton et al.
2005/0095066 A1 5/2005 Warren
2005/0120660 A1 6/2005 Kim et al.
2005/0136761 A1 6/2005 Murakami et al.
2005/0155305 A1 7/2005 Cosenza et al.
2005/0193660 A1 9/2005 Mead
2005/0222285 A1 10/2005 Massengill et al.
2006/0010817 A1 1/2006 Shull
2006/0030227 A1 2/2006 Hairston et al.
2006/0117692 A1 6/2006 Trout
2006/0178064 A1 8/2006 Balthes et al.
2007/0059516 A1 3/2007 Vincent et al.
2007/0137135 A1 6/2007 Shymkowich
2007/0199267 A1 8/2007 Moor
2007/0261342 A1 11/2007 Cummings
2008/0172967 A1 7/2008 Hilburn
2008/0193738 A1 8/2008 Hensley et al.
2008/0268231 A1 10/2008 Deib
2009/0036561 A1 2/2009 Nygren
2009/0223150 A1 9/2009 Baratuci et al.
2009/0223159 A1 9/2009 Colon
2009/0246498 A1 10/2009 Deiss
2009/0315269 A1 12/2009 Deiss
2010/0058696 A1 3/2010 Mills
2010/0275539 A1 11/2010 Shaw
2010/0281807 A1 11/2010 Bradford
2010/0319287 A1 12/2010 Shaw
2011/0016808 A1 1/2011 Hulburn, Jr.
2011/0083383 A1 4/2011 Hilburn, Jr.
2011/0088342 A1 4/2011 Stahl, Sr. et al.
2011/0135387 A1 6/2011 Derrigan et al.
2011/0247281 A1 10/2011 Pilz et al.
2012/0117900 A1 5/2012 Shaw
2014/0151968 A1 6/2014 Hensley et al.
2014/0219719 A1 8/2014 Hensley et al.
2014/0360118 A1 12/2014 Hensley et al.
2017/0284083 A1 * 10/2017 Hensley ..... F16J 15/022

FOREIGN PATENT DOCUMENTS

CA 1259351 A 9/1989
CA 1280007 2/1991
CA 2256660 A1 2/2000
CA 2296779 C 11/2006
CA 2640007 A1 3/2009
DE 4436280 A1 4/1996
DE 19809973 C1 7/1999
DE 102005054375 A1 5/2007
EP 0976882 A2 2/1999
EP 0942107 A2 9/1999
EP 1118715 A1 7/2001
EP 1118726 A1 7/2001
EP 1540220 A1 2/2004
EP 1540220 B1 8/2006
EP 1983119 A1 4/2007
EP 1983119 B1 10/2008
GB 9775329 12/1964
GB 1359734 7/1974

(56) References Cited

FOREIGN PATENT DOCUMENTS

| | | | |
|---|---|---|---|
| GB | 1495721 | | 12/1977 |
| GB | 1519795 | | 8/1978 |
| GB | 2181093 | A | 4/1987 |
| GB | 2251623 | A1 | 7/1992 |
| GB | 2359265 | A | 8/2001 |
| GB | 2377379 | A | 1/2003 |
| JP | 200645950 | A | 2/2006 |
| WO | 2003006109 | A1 | 1/2003 |
| WO | 2007023118 | A2 | 3/2007 |
| WO | 2007024246 | A1 | 3/2007 |

OTHER PUBLICATIONS

Iso-Chemie, ISO BLOCO 600, Produktbeskrivelse, Norwegian language, pp. 1-2, publication date unknown from document.
Ashida, Polyurethane and Related Foams, Chapter three: Fundamentals, p. 43, 45. pp. 1-3; publication date unknown from document.
Merritt, Protection against Hazards, Section 3.30-3.31, 1994, pp. 1-4.
Schultz, Fire and Flammability Handbook, p. 363, 1985, pp. 1-3.
Netherlands Standards Institute, Fire resistance tests for non-loadbearing elements—Part 1: Walls, Aug. 1999, NEN-EN 1364-1, pp. 1-32.
Troitzsch, Jurgen, International plastics flammability handbook, 1983, pp. 1-2.
Polytite Manufacturing Company, Polytite "R" Colorized Joint Sealant, Jan. 7, 1998, pp. 1-2.
Quelfire, Passive Fire Protection Products, catalog, pp. 1-68, publication date unknown from document.
Quelfire, Intufoam, pp. 1-4, publication date unknown from document.
Saint-Gobain Performance Plastics, Norseal V740, labeled Copyright 2001, pp. 1-2.
Sandell Manufacturing Company, Inc., Polytite Sealant and Construction Gasket, p. 1, publication date unknown from document.
Schul International Corporation, Hydrostop, Expansion Joint System, Jan. 17, 2001, pp. 1-2.
Illbruck, Sealtite-willseal, Plant Bodenwohr, pp. 1-17, publication date unknown from document.
Schul International Co., LLC., Sealtite "B" Type II, Part of the S3 Sealant System, Jan. 5, 2006, pp. 1-2.
Sealtite-willseal Joint Sealants, Equivalency Chart for Joint Sealants, p. 1, publication date unknown from document.
Schul International Co., LLC., Material Safety Data Sheet, Seismic Sealtite, revised date Oct. 23, 2002, pp. 1-3.
Sealtite-Willseal, Installation Procedures for Seismic Sealtite/250C Joint Sealant, Mar. 4, 2001, p. 1.
Tremco Illbruck Ltd., Technical Data Sheet, ALFASIL FR, Issue 3, pp. 1-2, Oct. 22, 2007.
Product Data Sheet, Art. No. 4.22.01 Compriband MPA, pp. 1-2, publication date unknown from document.
UL Online Certifications Directory, XHBN.GuideInfo, Joint Systems, last updated Sep. 21, 2013, pp. 1-4.
UL 1715 Fire Test of Interior Finish Material, http://ulstandardsinfonet.ul.com/scopes/1715.html[Oct. 7, 2014 3:27:15 PM], p. 1, publication date unknown from document.
Williams Products, Inc., Williams Everlastic 1715 Fire Classified Closures Tech Data, Oct. 2005, p. 1.
Williams Products, Inc., Everlastic Fire Classifed Closures 1715, http://williamsproducts.net/fire_classified_1715.html [Oct. 7, 2014 3:26:33 PM], pp. 1-3, publication date unknown from document.
Williams Products, Inc., Installation for partion closures, p. 1, publication date unknown from document.
Will-Seal Construction Foams, Will-seal is Tested to Perform, p. 1, publication date unknown from document.
Will-Seal Precompressed Foam Sealant, How Will-Seal Works, p. 1, publication date unknown from document.
Illbruck, Will-Seal, Basis of Acceptance, 3.0 Construction Requirements, Precompressed Foam Sealants, Section 07915, pp. 1-8, publication date unknown from document.
Emseal Joint Systems, Ltd., Emseal Colorseal Tech Data, Jul. 2009, p. 1-2.
Emseal Joint Systems, Ltd., Emseal Colorseal Tech Data, Mar. 2011, p. 1-2.
Emseal Joint Systems, Ltd., Emseal Horizontal Colorseal Tech Data, Aug. 2014, p. 1-2.
Emseal Joint Systems, Ltd., Emseal Seismic Colorseal Tech Data, Oct. 2009, pp. 1-2.
Emseal Joint Systems, Ltd., Emseal Seismic Colorseal Tech Data, Jun. 2010, pp. 1-2.
Emseal Joint Systems, Ltd., Emseal MST, Multi-Use Sealant Tape, Sep. 2008, pp. 1-2.
Emseal Joint Systems, Ltd., Emseal MST, Multi-Use Sealant Tape, Oct. 2013, pp. 1-2.
Emseal Joint Systems, Ltd., Emshield DFR2 System, Tech Data, Sep. 2014, pp. 1-4.
Emseal Joint Systems, Ltd., Emshield DFR2, last modified Sep. 19, 2014, pp. 1-4.
Emseal Joint Systems, Ltd., Emshield DFR3, last modified Sep. 4, 2014, pp. 1-5.
Emseal Joint Systems, Ltd., Emshield WFR2 and WFR3, last modified Sep. 3, 2014, pp. 1-5.
Emseal Joint Systems, Ltd., Colorseal-on-a-reel, last modified Nov. 10, 2014, pp. 1-3.
Emseal Joint Systems, Ltd., Colorseal, last modified Oct. 9, 2014, pp. 1-3.
Emseal GreyFlex Expanding Foam Sealant for Facades, p. 1, publication date unknown from document.
Emseal Joint Systems, Ltd., QuietJoint, Tech Data, Nov. 2012, pp. 1-2.
Emseal Corporation Ltd., Material Safety Data Sheet, QuietJoint, MSDS date May 13, 2014, pp. 1-2.
Emseal Joint Systems, Ltd., QuietJoint CAD Details, last modified Oct. 31, 2014, pp. 1-3.
http://www.emseal.com/products/architectural/QuietJoint/QuietJoint.htm, QuietJoint Mass-Loaded Acoustic Partition Closure, last modified Oct. 9, 2014, pp. 1-4.
http://www.emseal.com/products/architectural/QuietJoint/QuietJoint.htm, QuietJoint Mass-Loaded Acoustic Partition Closure, last modified Jul. 29, 2014, pp. 1-4.
http://www.emseal.com/products/architectural/QuietJoint/QuietJoint.htm, QuietJoint Mass-Loaded Acoustic Partition Closure, no intumescent coating, last modified Sep. 19, 2014, pp. 1-4.
http://williamsproducts.net/wide.html, Everlastic Wide Joint Seal, http://williamsproducts.net/wide.html[Oct. 7, 2014 3:37:39 PM], pp. 1-3, publication date unknown from document.
Baerveldt, Konrad, The Applicator—Dear Tom: Emseal has two EIFS Expansion Joint Answers for you, Jun. 1991, pp. 1-4.
Snapshot of Final Office Action for U.S. Appl. No. 90/013,473; dated Nov. 6, 2015, 38 pages.
ACI 504-R, Guide to Sealing Joint in Concrete Structures, ACI Committee 504, 1997, 44 pages.
DIN 4102-16, Fire Behaviour of Building Materials and Elements, Part 16, May 1998, pp. 1-12.
Snapshot of Office Action for U.S. Appl. No. 90/013,395; dated Apr. 7, 2016, 37 pages.
Snapshot of Office Action for U.S. Appl. No. 90/013,565; dated Apr. 8, 2016, 48 pages.
Emseal Joint Systems, Ltd., BEJS System Tech Data, Mar. 2009, 2 pages.
Emseal's new Universal-90 expansion joints, Buildingtalk, Pro-Talk Ltd., Mar. 27, 2009, 2 pages.
Emseal Joint Systems, Ltd., Emseal Emshield DFR2 System DFR3 System Tech Data, May 2010, 4 pages.
Emseal Seismic Colorseal, Aug. 21, 2007, 4 pages.
Emseal Joint Systems, Ltd., Emseal New Universal 90's Watertight, Factory Fabricated Upturn/Downturn Transition Pieces for Ensuring Continuity of Seal, Aug. 4, 2009, 4 pages.
Snapshot of Intent to Issue Ex Parte Reexamination Certificate for U.S. Appl. No. 90/013,428; Oct. 31, 2016, 7 pages.

(56) References Cited

OTHER PUBLICATIONS

Snapshot of Ex Parte Reexamination Certificate for U.S. Appl. No. 90/013,511; Oct. 31, 2016, 3 pages.
Snapshot of Ex Parte Reexamination Certificate for U.S. Appl. No. 90/013,565; Nov. 2, 2016, 3 pages.
Snapshot of Office Action for U.S. Appl. No. 14/950,930; dated Jun. 16, 2017, 6 pages.
Illbruck Construction Products, "Worldwide solutions to joint-sealing and acoustic problems", Apr. 9, 1998, 77 pages, Illbruck Construction Products, Wrexham, United Kingdom.
2000 Fire Resistance Directory, p. 1012; publication date unknown from document.
Firestop Submittal Package, Fire Resistive Joint Systems—Waterproofing, SpecSeal Firestop Products, Specified Technologies, Inc, Somerville NJ; p. 1-37, publication date unknown from document.
Specified Technologies Inc., Product Data Sheet, Series ES, Elastomeric Sealant, Copyright 2000, p. 1-4.
Specified Technologies Inc., Product Data Sheet, PEN200 Silicone Foam, Copyright 2003, p. 1-2.
ISO-Chemie GmbH, Schul International Co., Order Confirmation, Doc. No. 135652, Customer No. 38012, Date, Apr. 26, 2007, p. 1-3.
Dow Corning 890 Self-Leveling Silicone Joint Sealant; Dow Corning Corporation; 1996, 1999.
Snapshot of Office Action for U.S. Appl. No. 16/115,858; dated Mar. 15, 2019, 7 pages.
Snapshot of Notice of Allowance for U.S. Appl. No. 16/115,861; dated May 15, 2019, 5 pages.
Snapshot of Office Action for U.S. Appl. No. 15/633,196; dated Apr. 30, 2019, 17 pages.
Snapshot of Office Action for U.S. Appl. No. 15/386,907; dated May 13, 2019, 8 pages.
Salamander Industrial Products, Inc., blocoband HF—interior sealant, publication date unknown from document, 4 pages.
Emseal Joint Systems, Drawing SJS-100 in Recessed Block With Header Material, Jun. 7, 2006, 1 page.
Snapshot of Office Action issued in U.S. Appl. No. 90/013,428; dated 2015, 14 pages.
Snapshot of Notice of Allowance issued in U.S. Appl. No. 14/080,960; dated 2015, 5 pages.
Decision Granting Ex Parte Reexamination on Control No. 90/013,473, May 19, 2015, 13 pages.
U.S. Appl. No. 60/953,703, filed Aug. 3, 2007 underlying U.S. Pat. No. 8,397,453, 24 pages.
Snapshot of Decision Granting Ex-Parte Reexamination issued in U.S. Appl. No. 90/013,472; printed in 2015; 25 pages.
Snapshot of Notice of Allowance issued in U.S. Appl. No. 14/229,463; dated 2015; 8 pages.
Snapshot of Notice of Allowance issued in U.S. Appl. No. 13/731,327; dated 2015, 8 pages.
Snapshot of Office Action issued in U.S. Appl. No. 14/211,694; dated 2015, 14 pages.
Snapshot of Office Action issued in U.S. Appl. No. 13/652,021; dated 2015, 13 pages.
Snapshot of Office Action issued in U.S. Appl. No. 90/013,511; dated 2015, 24 pages.
Snapshot of Office Action issued in U.S. Appl. No. 14/278,210; dated 2015, 11 pages.
Snapshot of Office Action for U.S. Appl. No. 13/731,327; dated Jan. 4, 2017, 6 pages.
Snapshot of Notice of Allowance for U.S. Appl. No. 14/229,463; dated Jan. 5, 2017, 7 pages.
Snapshot of Notice of Allowance for U.S. Appl. No. 13/731,327; dated Feb. 10, 2017, 6 pages.
Snapshot of Office Action for U.S. Appl. No. 14/950,923; dated Jan. 10, 2018, 7 pages.
Snapshot of Notice of Allowance for U.S. Appl. No. 14/730,896; dated Jan. 16, 2018, 3 pages.
Underwriters Laboratories Inc., System WW-D0001, Fire Resistance Directory, vol. 2, Copyright 2000, 3 pages.
Underwriters Laboratories Inc., System FF-D-1010, 2000 Fire Resistance Directory, 2000, 1 page.
Emseal Joint Systems, Ltd., Seismic Colorseal—DS (Double-Sided), 2006, 3 pages.
Emseal Joint Systems, Ltd., BEJS System, Bridge Expansion Joint System, last modified Jul. 29, 2009, 5 pages.
Emseal Joint Systems, Ltd., AST Hi-Acrylic Metal Roof and Multi-Use Building Sealant, 2005, 2 pages.
Emseal Joint Systems, Ltd., BEJS System Install Data, Internet archive dated Sep. 22, 2010, 1 page.
Emseal, BEJS System—Bridge Expansion Joint System, May 26, 2010, 5 pages.
Emseal, Emseal Acrylic Log Home Tape Installation Instructions, Jun. 2011, 1 page.
Snapshot of Notice of Allowance for U.S. Appl. No. 13/652,021; dated Jan. 8, 2016, 7 pages.
Snapshot of Non-Final Office Action for U.S. Appl. No. 14/084,930; dated Jan. 12, 2016, 11 pages.
Snapshot of Office Action in Ex Parte Reexamination for U.S. Appl. No. 90/013,395; Jan. 20, 2016, 26 pages.
Snapshot of Ex Parte Reexamination Certificate for U.S. Appl. No. 90/013,428; Nov. 23, 2016, 3 pages.
Snapshot of Notice of Allowance for U.S. Appl. No. 14/540,514; dated Nov. 25, 2016, 4 pages.
Snapshot of Office Action for U.S. Appl. No. 14/278,210; dated Nov. 30, 2016, 12 pages.
Snapshot of Notice of Allowance for U.S. Appl. No. 12/635,062; dated Oct. 9, 2015, 5 pages.
Snapshot of Office Action for U.S. Appl. No. 90/013,511; dated Oct. 23, 2015, 28 pages.
Lester Hensley, "Where's the Beef in Joint Sealants? Hybrids Hold the Key," Applicator, vol. 23, No. 2, Spring 2001, pp. 1-5.
Emseal Joint Systems, Ltd, Seismic Colorseal, Tech Data, Apr. 1998, pp. 1-2.
Schul International Co., LLC, Sealtite VP Premium Quality Pre-compressed Joint Sealant for Weather tight, Vapor Permeable, Vertical Applications, Technical Data, dated Oct. 28, 2005, pp. 1-2.
ISO-Chemie GmbH, Product Data Sheet, ISO-FLAME Kombi F 120, pp. 1-2, UK-F010514; publication date unknown from document.
Schul International Co., LLC, Seismic Sealtite II, Colorized, Pre-compressed Joint Sealant for Vertical Applications, Technical Data, dated Sep. 20, 2006, pp. 1-2.
Dow Corning Corporation, Dow Corning 790 Silicone Building Sealant, copyright date 1995, 1999, pp. 1-5.
Emseal Joint Systems, LTD, Horizontal Colorseal, Tech Data, Nov. 2008, pp. 1-2.
Emseal Joint Systems, LTD, Seismic Colorseal, Tech Data, Jul. 2009, pp. 1-2.
Emseal Joint Systems, LTD, Horizontal Colorseal, Tech Data, Jul. 2009, pp. 1-2.
Emseal Joint Systems, LTD, Horizontal Colorseal, Tech Data, Jun. 2010, pp. 1-2.
Schul International Co., LLC, Sealtite "B", Pre-compressed Joint Sealant, Premium Quality for Secondary Sealant Applications, Technical Data, dated Oct. 28, 2005, pp. 1-2.
ISO-Chemie GmbH, ISO-FLAME Kombi F 120, 2006, German, pp. 1-2.
ISO-Chemie GmbH, Order Confirmation Sheet, dated Apr. 26, 2007, pp. 1-3.
ISO-Flame Kombi F 120, Net Price List, Schul International Co., dated Jun. 27, 2006, pp. 1.
Tremco Illbruck Limited, Compriband Super FR, Fire Rated Acrylic Impregnated Foam Sealant Strip, Issue 3, dated Apr. 12, 2007, pp. 1-2.
Figure 1: The BS 476; Part 20 & EN 1363-1 time temperature curve, pp. 1; publication date unknown from document.
Schul International Co., LLC, Sealtite, Premium Quality Pre-compressed Joint Sealant for Waterproof Vertical Applications, pp. 1; publication date unknown from document.
Schul International Co., LLC, Sealtite 50N, Premium Quality Pre-compressed Joint Sealant for Horizontal Applications, dated Oct. 28, 2005, pp. 1-2.

(56) References Cited

OTHER PUBLICATIONS

Will-Seal, Signed, Sealed & Delivered, pp. 1; publication date unknown from document.
Illbruck/USA, Will-Seal 150 Impregnanted Precompressed Expanding Foam Sealant Tape, Spec-Data Sheet, Joint Sealers, dated Nov. 1987, pp. 1-2.
Illbruck, Inc., Will-Seal 250 Impregnanted Precompressed Expanding Foam Sealant Tape, Spec-Data Sheet, Joint Sealers, dated Aug. 1989, pp. 1-2.
U.S. Department of Labor, Material Safety Data Sheet, Identity: Willseal 150/250 and/or E.P.S., date prepared Jul. 21, 1986, pp. 1-2.
Illbruck, TechSpec Division Facade & Roofing Solutions, ALFAS compriband, Mar. 2005, pp. 1-10.
Salamander Industrial Products, Inc., blocoband HF—interior sealant, pp. 1; publication date unknown from document.
Dow Corning Corporation, Dow Corning 790 Silicone Building Sealant, copyright 2000-2005, pp. 1-2.
Grace Fireproofing Products. Monokote Z-146T. 2007, pp. 1-2.
Polyurethane Foam Field Joint Infill Systems, Sep. 23, 2007 (via Snagit), PIH, pp. 1-5.
International Search Report and Written Opinion for PCT/US2014/032212, dated Aug. 25, 2014, pp. 1-13.
Grunau Illertissen GmbH, Fir-A-Flex, Fire Protection for Linear Gaps in Walls and Ceilings, dated Aug. 1996, pp. 1-4.
UL Standard for Safety for Rests for Fire Resistance of Building Joint Systems, UL 2079, Underwriters Laboratories Inc. (UL); Fourth Edition; dated Oct. 21, 2004.
Emseal "Pre-cured-Caulk-and-Backerblock" Not New, Not Equal to Emseal's Colorseal, Jul. 19, 2012.
Emseal Drawing Part No. 010-0-00-00 dated Dec. 6, 2005.
Emseal Horizontal Colorseal Tech Data, dated Jun. 1997.
Emseal Joint Systems, Drawing SJS-100-CHT-N, Nov. 20, 2007.
Emseal Technical Bulletin, Benchmarks of Performance for High-Movement Acrylic-Impregnated, Precompressed, Foam Sealants when Considering Substitutions, Jul. 3, 2012.
Emseal, Colorseal & Seismic Colorseal, May 1997, Install Data Colorseal & Seismic Colorseal, p. 1-2.
Emseal, Colorseal, Jan. 2000, Colorseal TechData, p. 1-2.
Emseal, Is there a gap in your air barrier wall design?, Jul. 19, 2012.
Manfredi, L. "Thermal Degradation and Fire Resistance of Unsaturated Polyester, Modified Acrylic Resins and their Composites with Natural Fibres"; Science Direct, 2005.
Stein et al., "Chlorinated Paraffins as Effective Low Cost Flame Retardants for Polyethylene"; publication date unknown from document.
DIN 4102, Part 2, Fire Behaviour of Building Materials and Building Components, Sep. 1977.
Emseal Joint Systems, Ltd., Material Safety Data Sheet for AST-HI-ACRYLIC, pp. 1-2, date issued Apr. 2002.
Iso-Chemie, GmbH., Iso-Bloco 600, pp. 1-2, EN-B010706; publication date unknown from document.
Iso-Chemie, GmbH., Iso-Flame Kombi F 120, pp. 1-2., 2006.
Underwriters Laboratories Inc., UL Standard for Safety for Fire Tests of Building Construction and Materials, UL 263, Thirteenth Edition, Apr. 4, 2003, pp. 1-40.
Adolf Wurth GmbH & Co., KG, Elastic Joint Sealing Tape, labeled Copyright 2000-2003, pp. 1-7.
Expanding PU Foam, Technical Data Sheet, Feb. 1997, pp. 1-2.
ASTM International, Designation: E 84-04, Standard Test Method for Surface Burning Characteristics of Building Materials, Feb. 2004, pp. 1-19.
ASTM International, Designation: E 176-07, Standard Terminology of Fire Standards, Oct. 2007, pp. 1-20.
Auburn Manufacturing Company, Auburn Product News, Flame Retardant Silicone Sponge, 2007, p. 1.
British Board of Agrement, Agrement Certificate No. 97/3331, Second Issue, Compriband Super, 2005, pp. 1-4.
British Board of Agrement, Agrement Certificate No. 96/3309, Third Issue, Illmod 600 Sealing Tapes, 2003, pp. 1-8.
Nederland Normalistie-Instituut, Experimental Determination of the Fire Resistance of Elements of Building Construction, NEN 6069, Oct. 1991, English Translation, pp. 1-30.
British Standards Institution, Fire Tests on Building Materials and Structures, BS 476: Part 20: 1987, pp. 1-44.
DIN Deutsches Institut for Normung e.V., DIN 18542, Impregnated Cellular Plastics Strips for Sealing External Joints, Requirements and Testing, Jan. 1999, pp. 1-10.
www.BuildingTalk.com, Emseal Joint Systems, Choosing a Sealant for Building Applications, Hensley. May 21, 2007, pp. 1-6.
Netherlands Organization for Applied Scientific Research (TNO), Determination of the Fire Resistance According to NEN 6069 of Joints in a Wall Sealed with Cocoband 6069 Impregnated Foam Strip, Nov. 1996, pp. 1-19.
DIN Deutsches Institut fur Normung e.V., Fire Behaviour of Building Materials and Elements, Part 1: Classification of Building Materials, Requirements and Testing, DIN 4102-1, May 1998, pp. 1-33.
DIN Deutsches Institut fur Normung e.V., Fire Behaviour of Building Materials and Elements, Overview and Design of Classified Building Materials, Elements and Components, DIN 4102-4, Mar. 1994, pp. 1-144.
Dow Corning Corporation, Dow Corning 790, Silicone Building Sealant, labeled Copyright 2000, pp. 1-6.
Dow Corning Corporation, Dow Corning 790, Silicone Building Sealant, Product Information, labeled Copyright 2000-2004, pp. 1-4.
Dow Corning Corporation, Dow Corning Firestop 400 Acrylic Sealant, 2001, pp. 1-4.
Dow Corning Corporation, Dow Corning Firestop 700 Silicone Sealant, 2001, pp. 1-6.
Emseal Joint Systems, Horizontal Colorseal, Aug. 2000, pp. 1-2.
Emseal Joint Systems, Ltd., Colorseal PC/SA Stick STD/001-0-00-00, 1995, p. 1.
Emseal Joint Systems, Ltd., 20H System, Tech Data, Jun. 1997, pp. 1-2.
Emseal Joint Systems, Ltd., Colorseal, Aug. 2000, pp. 1-2.
Emseal Joint Systems, Ltd., DSH System, Watertight Joint System for Decks, Tech Data, Nov. 2005, pp. 1-2.
Emseal Joint Systems, Ltd., Fire-Rating of Emseal 20H System, Feb. 17, 1993, p. 1-2.
Emseal Joint Systems, Ltd., Preformed Sealants and Expansion Joint Systems, May 2002, pp. 1-4.
Emseal Joint Systems, Ltd., Pre-Formed Sealants and Expansion Joints, Jan. 2002, pp. 1-4.
Emseal Joint Systems, Ltd., Seismic Colorseal, Aug. 2000, pp. 1-2.
Emseal Joint Systems, Ltd., Seismic Colorseal-DS (Double-Sided) Apr. 12, 2007, pp. 1-4.
Environmental Seals, Ltd., Envirograf, Fire Kills: Stop it today with fire stopping products for building gaps and openings, 2004, pp. 1-8.
Fire Retardants, Inc., Fire Barrier CP 25WB+Caulk, labeled Copyright 2002, pp. 1-4.
Illbruck Bau-Produkte GmbH u. CO. KG., willseal firestop, Product Information Joint Sealing Tape for the Fire Protection Joint, Sep. 30, 1995, pp. 1-9.
Illbruck, willseal, The Joint Sealing Tape, 1991, pp. 1-19.
Illbruck, willseal 600, Product Data Sheet, 2001, pp. 1-2.
Material Safety Data Sheet, Wilseal 150/250 and/or E.P.S., Jul. 21, 1986, pp. 1-2.
ISO 066, Technical Datasheet, blocostop F-120, 2002 p. 1.
MM Systems, ejp Expansion Joints, Expanding Impregnated Foam System, intemet archive, wayback machine, Nov. 16, 2007, pp. 1-2.
MM Systems, ejp Expansion Joints, Colorjoint/SIF—Silicone Impregnated Foam System, internet archive, wayback machine, Nov. 16, 2007, pp. 1-2.
MM Systems, ColorJoint/SIF Series, Silicone Seal & Impregnated Expanding Foam, Spec Data, 2007, pp. 1-3.
Norton Performance Plastics Corporation, Norseal V740FR, Flame Retardant, UL Recognized Multi-Purpose Foam Sealant, labeled Copyright 1996, pp. 1-2.
Promat International,Ltd., Promaseal FyreStrip, Seals for Movement Joints in Floors/Walls, labeled Copyright 2006, pp. 1-4.

(56) References Cited

OTHER PUBLICATIONS

Promat International, Ltd., Promaseal Guide for Linear Gap Seals and Fire Stopping Systems, Jun. 2008, pp. 1-20.
Promat International, Ltd., Promaseal IBS Foam Strip, Penetration Seals on Floors/Walls, labeled Copyright 2004, pp. 1-6.
Promat International, Ltd., Safety Data Sheet, Promaseal IBS, May 25, 2007, pp. 1-3.
Schul International, Co., LLC., Color Econoseal, Technical Data, Premium Quailty Joint Sealant for Waterproof Vertical and Horizontal Applications, 2005, pp. 1-2.
Schul International, Co., LLC., Sealtite Airstop FR, Air and Sound Infiltration Barrier, labeled Copyright 1997-04, p. 1.
Schul International, Co., LLC., Sealtite Standard, Pre-compressed Joint Sealant, High Density, Polyurethane Foam, Waterproofs Vertical Applications, 2007.
Snapshot of Advisory Action for U.S. Appl. No. 90/013,565; dated Jul. 19, 2016, 5 pages.
Mercury et al., "On the Decomposition of Synthetic Gibbsite Studied by Neutron Thermodiffractometry", J. Am. Ceram, Soc. 89, (2006), pp. 3728-3733.
Brydon et al., "The Nature of Aluminum Hydroxide-Montmorillonite Complexes", The American Minerologist, vol. 51, May-Jun. 1966, pp. 875-889.
Huber, Alumina Trihydrate (ATH), a Versatile Pigment for Coatings, Inks, Adhesives, Caulks and Sealants Applications, Dec. 2005, 5 pgs.
3.3.3.8 Thermal Stability/Loss on Ignition/Endotheric Heat, Figure 3.9, 1 pg.
Schul International Co., LLC., Sealtite VP (600) Technical Data, Premium Quality Pre-compressed Joint Sealant for Weather tight, Vapor Permeable, Vertical Applications, labeled Copyright 1997-2002, pp. 1-2.
Schul International Co., LLC., Seismic Sealtite, Technical Data, Colorized, Pre-compressed Joint Sealant for Vertical Applications, 2005, pp. 1-2.
Schul International Co., LLC., Sealtite 50N, Technical Data, Premium Quality Pre-compressed Joint Sealant for Horizontal Applications, labeled Copyright 2002, pp. 1-2.
Schul International Co., LLC., HydroStop, Expansion Joint System, 2005, pp. 1-2.
Schul International Co., LL., Sealtite, The Most Complete Line of Pre-compressed Sealants, web archive.org, wayback machine, printed 2014, pp. 1-3.
Sealant, Waterproofing & Restoration Institute, Sealants: The Professional Guide, labeled Copyright 1995, Chapter II-Sealants, p. 26, pp. 1-3.
Tremco Illbruck, Cocoband 6069, 2007, p. 1 with English translation.
Tremco Illbruck, Alfacryl FR Intumescent Acrylic, Fire Rated, Emulsion Acrylic, Intumescent Sealant, 2007, pp. 1-2.
Tremco Illbruck, Alfasil FR, Fire Rated, Low Modulus, Neutral Cure Silicone Sealant, 2007, pp. 1-2.
Tremco Illbruck, Compriband 600, Impregnated Joint Sealing Tape, 2007, pp. 1-2.
Tremco Illbruck, Compriband Super FR, Fire Rated Acrylic Impregnated Foam Sealant Strip, 2007, pp. 1-2.
Tremco Illbruck, Ltd., Technical Data Sheet, Compriband Super FR, Issue 2, Oct. 18, 2004, pp. 1-4.
Tremco Illbruck, Ltd., Technical Data Sheet, Compriband Super, Issue 1, Sep. 29, 2004, pp. 1-3.
Illbruck, TechSpec Division Facade & Roofing Solutions, Mar. 2005, pp. 1-10.
Tremco Illbruck, Alfas Bond FR, 2007, pp. 1-2.
Tremco Illbruck, Illmod 600, Jun. 2006, pp. 1-2.
Tremco Illbruck, The Specification Product Range, 2007, pp. 1-36.
Tremco Illbruck, Webbflex B1 PU Foam, Fire Rated Expanding Polyurethane Foam, Sep. 11, 2006, pp. 1-2.
UL Online Certifications Directory, System No. WW-S-0007, XHBN. WW-S-0007, Joint Systems, Dec. 5, 1997, pp. 1-3.
UL Online Certifications Directory, BXUV.GuideInfo, Fire-Resistance Ratings ANSI/UL 263, last updated Jun. 26, 2014, pp. 1-24.
Frangi et al., German language, Zum Brandverhalten von Holzdecken aus Hohlkasten-elementen, Institut fur Baustatik und Konstruktion, Jun. 1999, pp. 1-130.
ASTM International, Designation: E 1966-01, Standard Test Method for Fire-Resistive Joint Systems, current edition approved Oct. 10, 2001. Published Jan. 2002, pp. 1-15.
www.businesswire.com, Celanese Introduces Mowilith Nano Technology Platform for the Next General of Exterior Coatings, Nurnberg, Germany, May 8, 2007, pp. 1-3.
Illbruck, Willseal firestop applied in the joints of the new Pfalz Theater in Kaiserlautern, pp. 1-2; publication date unknown document.
Dayton Superior Chemical & Cement Products, Marketing Update, Fall 2005, pp. 1-2.
Dow Corning Case Study EU Parliament, Brussels, p. 1; publication date unknown from document.
Dow Corning Silicone Sealants, Dow Corning 790 Silicone Building Sealant, Ultra-low-modulus sealant for new and remedial construction joint sealing applications, labeled Copyright 2000-2005, pp. 1-2.
Dow Corning, John D. Farrell Letter to Emseal USA, Wilford Brewer, reference: Emseal Greyflex, Oct. 4, 1984, p. 1.
Dow Corning letter to Customer, Reference: Sealant Certification for Dow Corning 790 Silicone Building Sealant, p. 1; publication date unknown from document.
Emseal Joint Systems, Ltd., Greyflex & Backerseal Wet Sealant Compatibility Chart, Test Data, Sep. 1991, p. 1.
Emseal Joint Systems, Emseal preformed expanding foam sealant, 07920/MAN, pp. 1-2; publication date unknown from document.
Colorseal by Emseal Specification Sections 07 90 00/ 07 95 00, pp. 1-4, publication date unknown from document.
Emseal Joint Systems, Ltd., Emseal Color-seal, Tech Data, pp. 1-2, publication date unknown from document.
Emseal Joint Systems, Ltd., Emseal Color-Seal, p. 1, publication date unknown from document.
www.emseal.com/products, Horizontal Colorseal by Emseal Expansion Joints and Pre-Compressed Sealants, last modified Sep. 19, 2014.
Horizontal Colorseal by Emseal, Specification Sections 07 90 00/ 07 95 00, pp. 1-4; publication date unknown document.
Emseal Material Safety Data Sheet, Acrylic Loghome Tape, pp. 1-2, issued Apr. 2002.
Seismic Colorseal by Emseal Specification Sections 07 90 00/ 07 95 00, pp. 1-4; publication date unknown from document.
Emseal Joint Systems, Ltd., Summary Guide Specification, p. 1; publication date unknown from document.
Emseal Joint Systems, The complete package for all joint requirements, 1988, pp. 1-6.
Envirograf, Cavity Barriers Fire Seal Range, Technical Data, pp. 1-32; publication date from unknown from document.
web.archive.org, www.envirograf.com, Product 40: Intumescent-Coated Fireproof Sponge (patented), labeled Copyright 2007, pp. 1-2.
web.archive.org, www.envirograf.com, Product 5: Intumescent-Coated Non-Fibrous Slabs (patented), labeled Copyright Apr. 10, 2007, p. 1.
Afk Yapi Elemanlari, Hannoband-BSB Bg1, Fire prevention tape Flame resistand pursuant to DIN 4102 T1, Technical Data Sheet, pp. 1-4; publication date unknown document.
Hanno Dicht-und Dammsysteme, Hannoband-BG1, High Performance am Bau, German language, 2000, pp. 1-6.
Illbruck, willseal firestop fur die Brandschutz-Fuge, Information,German language, pp. 1-2; publication date unknown from document.
Illbruck Sealant Systems, Cocoband 6069, Productinfomatie, Dutch language, 2003, pp. 1-2.
Illbruck Sealant Systems, Inc., Sealant Products and Systems, 2002, pp. 1-12.
Illbruck, Will-Seal, 3.0 Construction Requirements, pp. 1-8; publication date unknown from document.

(56) References Cited

OTHER PUBLICATIONS

Sealtite Joint Sealants, What is the material used in the U-Channel? pp. 1-4; publication date unknown from document.
Snapshot of Advisory Action for U.S. Appl. No. 90/013,395; dated Sep. 14, 2016, 16 pages.
Snapshot of Intent to Issue Ex Parte Reexamination Certificate for U.S. Appl. No. 90/013,511; Sep. 21, 2016, 9 pages.
Snapshot of Notice of Intent to Issue Ex Patent Reexamination Certificate for U.S. Appl. No. 90/013,472; Feb. 19, 2016, 8 pages.
www.stifirestop.com, Specified Technologies, Inc., Product Data Sheet, Series ES Elastomeric Sealant, Copyright 2004, pp. 1-4.
www.stifirestop.com, Specified Technologies, Inc., Product Data Sheet, Pensil PEN300 Silicone Sealant, Copyright 2004, pp. 1-4.
Snapshot of Office Action issued in U.S. Appl. No. 14/540,514; dated 2015, 22 pages.
DIN 4102-1, Fire Behaviour of Building Materials and Elements, Part 1, May 1998, pp. 1-33.
DIN 4102-2, Fire Behaviour of Building Materials and Building Components, Part 2, Sep. 1977, pp. 1-11.
DIN 4102-15, Fire Behaviour of Building Materials and Elements, Part 15, May 1990, pp. 1-15.
DIN 18542, Impregnated Cellular Plastics Strips for Sealing External Joints, Jan. 1999, pp. 1-10.
ASTM International, Standard Test Method for Surface Burning Characteristics of Building Materials, Designation: E-84-04, Feb. 2004, pp. 1-19.
Illbruck Bau-Technik GmbH, Illbruck Illmod 600, Jan. 2002, pp. 1-2.
Illbruck Sealant Systems, Inc., Illbruck Willseal 600, 2001, pp. 1-2.
Iso-Chemie GmbH., Iso-Bloco 600, pp. 1-2, publication date unknown from document.
Iso-Chemie GmbH., Iso-Flame Kombi F 120, pp. 1-2, copyright 2001.
Schul International, Co., LLC., Seismic Sealtite II, Colorized, Pre-compressed Joint Sealant for Vertical Applications, Technical Data, 2006, pp. 1-2.
Underwriters Laboratories, Inc., Standard for Safety, Tests for Fire Resistance of Building Joint Systems, UL-2079, Fourth Edition, Dated Oct. 21, 2004, Revisions through and including Jun. 30, 2008, pp. 1-38.
MM Systems Corp., MM DSS Expansion Joint, Dual Seal Self-Expanding Seismic System, Feb. 18, 2008, pp. 1-2.
Order Granting Request for Ex Parte Reexamination for U.S. Pat. No. 8,739,495, Dec. 12, 2014, Control No. 90/013,395, pp. 1-19.
Emseal Joint Systems, Ltd., Fire-Rating of Emseal 20H System, Feb. 17, 1993, p. 1.
c:\wp\slsmtg\20hdbj.tbl Apr. 18, 1993, 20H-Description, Benefits, Justification, p. 1.
Order Granting Request for Ex Parte Reexamination for U.S. Pat. No. 8,813,449, Feb. 11, 2015, Control No. 90/013,428, pp. 1-19.
Defendants' Joint Second Amended Preliminary Invalidity Contentions received at MKG Jun. 30, 2015, Appendix A, 7 pgs.
Defendants' Joint Second Amended Preliminary Invalidity Contentions received at MKG Jun. 30, 2015, Appendix B-1, 346 pgs.
Defendants' Joint Second Amended Preliminary Invalidity Contentions received at MKG Jun. 30, 2015, Appendix B-2, 314 pgs.
Defendants' Joint Second Amended Preliminary Invalidity Contentions received at MKG Jun. 30, 2015, Appendix C, 159 pgs.
Defendants' Joint Second Amended Preliminary Invalidity Contentions received at MKG Jun. 30, 2015, Appendix D, 5 pgs.
Defendants' Joint Second Amended Preliminary Invalidity Contentions received at MKG Jun. 30, 2015, 1:14-cv-00358-SM, 27 pgs. total.
Snapshot of Office Action issued in U.S. Appl. No. 90/013,395; dated 2015, 27 pages.
Report on the Filing or Determination of an Action Regarding a Patent or Trademark, Docket No. 1:14-cv-358-SM, Filed Aug. 13, 2014 regarding U.S. Pat. No. 8,739,495, p. 1.
Report on the Filing or Determination of an Action Regarding a Patent or Trademark, Docket No. 1:14-cv-359-PB, Filed Aug. 13, 2014 regarding U.S. Pat. No. 8,739,495, p. 1.
Plastics Flammability Handbook, pp. 52, 59, and 60, 3 pages; publication date unknown from document.
Defendants' Answer, Counterclaims, Affirmative Defenses, and Jury Demand, 1:14-cv-00359-PB, Doc. 11, filed Oct. 3, 2014, 20 pages.
Defendants' Objection to Plaintiff's Partial Motion to Dismiss, 1:14-cv-00358-SM, Doc. 24, filed Nov. 10, 2014, pp. 1-3.
Defendants' Objection to Plaintiff's Motion to Strike Defendants' Tenth Affirmative Defense, 1:14-cv-00358-SM, Doc. 25, filed Nov. 12, 2014, pp. 1-3.
Defendants' Answer, Counterclaims, and Affirmative Defenses to Plaintiff's Consolidated Complaint, 1:14-cv-00358-SM, Doc. 38, filed Dec. 9, 2014, pp. 1-48.
Defendants' Objection to Plaintiff's Partial Motion to Dismiss Count III of Defendants' Counterclaim, 1:14-cv-00358-SM, Doc. 50, filed Jan. 16, 2015, pp. 1-15.
Defendants' Surreply to Plaintiff's Partial Motion to Dismiss Count II of Defendants' Counterclaims, 1:14-cv-00358-SM, Doc. 55, filed Feb. 13, 2015, pp. 1-6.
Joint Claim Construction and Prehearing Statement, 1:14-cv-00358-SM, Doc. 56, filed Mar. 3, 2015, pp. 1-9.
Lester Hensley, "Where's the Beef in Joint Sealants? Hybrids Hold the Key" AWCI's Construction Dimensions, Jan. 2006, 3 pgs.
IsoChemie, Iso-Bloco 600, Correspondence of Jun. 8, 2006, 13 pages.
Shul International Company, Invoice #18925 to P. J. Spillane, Sep. 14, 2007, 5 pages.
Illbruck Inc., Tested Physical Properties, 1994, 1 page.
Andrea Frangi, Zum Brandverhalten von Holzdecken aus Hohlkastenelementen; Jun. 1999; 125 pages (English Translation).
Defendants' Joint First Amended Preliminary Invalidity Contentions received at MKG Mar. 17, 2015, 1:14-cv-00358-SM, 25 pgs. total.
Defendants' Joint First Amended Preliminary Invalidity Contentions received at MKG Mar. 17, 2015, Appendix A, 6 pgs.
Defendants' Joint First Amended Preliminary Invalidity Contentions received at MKG Mar. 17, 2015, Appendix B, 270 pgs.
Defendants' Joint First Amended Preliminary Invalidity Contentions received at MKG Mar. 17, 2015, Appendix B, 376 pgs.
Defendants' Joint First Amended Preliminary Invalidity Contentions received at MKG Mar. 17, 2015, Appendix C, 125 pgs.
Defendants' Joint First Amended Preliminary Invalidity Contentions received at MKG Mar. 17, 2015, Appendix D, 4 pgs.
IBMB, Test Report No. 3263/5362, Jul. 18, 2002, English Translation, 14 pgs.
IBMB, Test Report No. 3263/5362, Jul. 18, 2002, German, 13 pgs.
IBMB, Test Certificate No. 3002/2719, Mar. 22, 2000, English Translation, 14 pgs.
IBMB, Test Certificate No. P-3568/2560-MPA BS, Sep. 30, 2000, English Translation, 22 pgs.
IBMB, Test Certificate No. P-3568/2560-MPA BS, Sep. 30, 2000, German, 14 pgs.
IFT Rosenheim, Evidence of Performance Test Report 105 324691/e U, Apr. 19, 2006, 8 pgs.
Snapshot of Office Action for U.S. Appl. No. 14/927,047; dated Mar. 16, 2018, 26 pages.
Snapshot of Office Action for U.S. Appl. No. 15/583,239; dated Mar. 21, 2018, 8 pages.
Snapshot of Office Action for U.S. Appl. No. 14/950,930; dated Mar. 21, 2018, 7 pages.
Snapshot of Office Action for U.S. Appl. No. 90/013,428; May 6, 2016, 22 pages.
Snapshot of Office Action for U.S. Appl. No. 14/950,923; dated May 6, 2016, 13 pages.
Snapshot of Office Action for U.S. Appl. No. 14/730,896; dated May 9, 2016, 18 pages.
Snapshot of Office Action for U.S. Appl. No. 14/229,463; dated May 12, 2016, 14 pages.
Snapshot of Advisory Action for U.S. Appl. No. 90/013,511; dated May 9, 2016, 12 pages.

(56) References Cited

OTHER PUBLICATIONS

Snapshot of Ex Parte Reexamination Certificate No. U.S. Pat. No. 6,532,708C2 for U.S. Appl. No. 90/013,683; Jun. 7, 2016, 2 pages.
Snapshot of Office Action for U.S. Appl. No. 14/278,210; dated May 19, 2016, 12 pages.
Snapshot of Office Action for U.S. Appl. No. 14/511,394; dated May 13, 2016, 6 pages.
Snapshot of Advisory Action for U.S. Appl. No. 90/013,395; dated May 20, 2016, 4 pages.
Snapshot of Office Action for U.S. Appl. No. 15/386,907; dated Nov. 1, 2018, 8 pages.
Snapshot of Office Action for U.S. Appl. No. 15/589,329; dated Nov. 1, 2018, 13 pages.
Snapshot of Office Action for U.S. Appl. No. 15/633,196; dated Nov. 1, 2018, 17 pages.
Snapshot of Office Action for U.S. Appl. No. 15/633,176; dated Nov. 1, 2018, 15 pages.
Snapshot of Office Action for U.S. Appl. No. 14/927,047; dated Nov. 13, 2018, 32 pages.
Snapshot of Non-Final Office Action for U.S. Appl. No. 13/731,327; dated Mar. 18, 2016, 27 pages.
Snapshot of Final Office Action for U.S. Appl. No. 14/211,694; dated Mar. 21, 2016, 16 pages.
Snapshot of Final Office Action for U.S. Appl. No. 14/455,398; dated Mar. 29, 2016, 12 pages.
Snapshot of Ex Parte Reexamination Certificate No. U.S. Pat. No. 6,532,708C1 for U.S. Appl. No. 90/013,472; Mar. 23, 2016, 3 pages.
Snapshot of Final Office Action for U.S. Appl. No. 14/540,514; dated Mar. 31, 2016, 18 pages.
Emseal Corporation, Seismic Colorseal by Emseal, "Last Modified": Aug. 21, 2007, 4 pages.
Emseal Joint Systems, Ltd., Backerseal (Greyflex), Sep. 2001, 2 pages.
Emseal Joint Systems, Ltd., Install Data—Horizontal Colorseal—With Expoxy Adhesive, Jun. 2006, 2 pages.
Notification of Transmittal of International Preliminary Report on Patentability in PCT/US14/32212; dated Mar. 13, 2015; 4 pages.
Snapshot of Office Actions issued in U.S. Appl. No. 13/729,500; dated 2015; 35 pages.
Snapshot of Office Actions issued in U.S. Appl. No. 14/278,210; dated 2015; 27 pages.
Snapshot of Office Actions issued in U.S. Appl. No. 12/635,062; dated 2015; 88 pages.
Snapshot of Office Actions issued in U.S. Appl. No. 13/731,327; dated 2015; 42 pages.
Snapshot of Office Action issued in U.S. Appl. No. 14/455,398; dated 2015; 9 pages.
Snapshot of Office Actions issued in U.S. Appl. No. 13/652,021; dated 2015; 34 pages.
Snapshot of Office Actions issued in U.S. Appl. No. 14/080,960; dated 2015; 10 pages.
Snapshot of Office Actions issued in U.S. Appl. No. 14/084,930; dated 2015; 7 pages.
Snapshot of Office Action issued in U.S. Appl. No. 14/229,463; dated 2015; 20 pages.
Snapshot of Office Action issued in U.S. Appl. No. 14/455,403; dated 2015; 12 pages.
Snapshot of Office Action issued in U.S. Appl. No. 14/211,694; dated 2015; 6 pages.
List of several Emseal pending patent applications and patents, and Examiners assigned thereto; Apr. 2015; 2 pages.
Snapshot of Advisory Action for U.S. Appl. No. 90/013,428; dated Sep. 8, 2016, 13 pages.
Snapshot of Notice of Allowance for U.S. Appl. No. 14/511,394, dated Feb. 17, 2017, 5 pages.
Snapshot of Notice of Allowance for U.S. Appl. No. 14/455,398; dated Mar. 13, 2017, 9 pages.
Snapshot of Notice of Allowance for U.S. Appl. No. 13/729,500; dated Mar. 15, 2017, 9 pages.
Snapshot of Notice of Allowance for U.S. Appl. No. 14/278,210; dated Mar. 13, 2017, 8 pages.
Schul International Co., LLC., Firejoint 2FR-H, Fire Rated Expansion Joint 2 Hour Fire Rated, labeled Copyright 2012, pp. 1-2.
Willseal LLC, Product Data Sheet, Willseal FR-H, Horizontal 2 and 3 hour fire rated seal, labeled Copyright 2013, pp. 1-2.
Schul International Co., LLC., Firejoint 2FR-V, Fire Rated Expansion Joint-2 Hour Fire Rated, labeled Copyright 2012, pp. 1-2.
Willseal LLC, Product Data Sheet, Willseal FR-V, Vertical 2 and 3 hour fire rated seal, labeled Copyright 2013, pp. 1-2.
UL Online Certifications Directory, System No. FF-D-0082, XHBN. FF-D-0082 Joint Systems, Jul. 29,2013, pp. 1-2.
UL Online Certifications Directory, System No. FF-D-1100, XHBN. FF-D-1100 Joint Systems, Sep. 24, 2012, pp. 1-2.
UL Online Certifications Directory, System No. WW-D-2013, XHBN. WW-D-2013 Joint Systems, May 27, 2004, pp. 1-2.
UL Online Certifications Directory, System No. FF-D-2008, XHBN. FF-D-2008 Joint Systems, Mar. 31, 2003, pp. 1-2.
UL Online Certifications Directory, System No. FF-D-1053, XHBN. FF-D-1053 Joint Systems, Nov. 28, 2007, pp. 1-2.
UL Online Certifications Directory, System No. WW-D-3005, XHBN. WW-D-3005 Joint Systems, Nov. 15, 1999, pp. 1-2.
UL Online Certifications Directory, XHHW.R8196 Fill, Void or Cavity Materials, labeled Copyright 2014, pp. 1.
UL Online Certifications Directory, XHBN.FF-D-0075 Joint Systems, Apr. 30, 2010, pp. 1-2.
UL Online Certifications Directory, System No. FF-D-0075, XHBN. FF-D-0075 Joint Systems, Aug. 21, 2014, pp. 1-2.
UL Online Certifications Directory, XHBN.FF-D-0094 Joint Systems, Sep. 11, 2013, pp. 1-2.
UL Online Certifications Directory, XHBN.FF-D-1121 Joint Systems, Apr. 25, 2013, pp. 1-2.
UL Online Certifications Directory, System No. FF-D-2006, XHBN. FF-D-2006 Joint Systems, Jun. 28, 2002, pp. 1-3.
Underwriters Laboratories (UK) Ltd., Assessment Report, Project No. 12CA37234, Aug. 24, 2012, pp. 1-20.
Emseal Joint Systems, Ltd., 2 inch Quietjoint—concrete to concrete, Part No. SHH_2_WW_CONC, Mar. 25, 2014, p. 1.
Emseal Joint Systems, Ltd., 2 inch Quietjoint—gypsum to gypsum, Part No. SHH_2_WW_GYP, Mar. 25, 2014, p. 1.
Emseal Joint Systems, Ltd., 2 inch Quietjoint at concrete wall to window, Part No. SHG_2_WW_CONC_TO_GLASS_INSIDE_CORNER, Mar. 25, 2014, p. 1.
Emseal Joint Systems, Ltd., 2 inch Quietjoint at Gypsum Wall to Window, Part No. SHG_2_WW_GL_INSIDE_CORNER_GYP, Mar. 25, 2014, p. 1.
Emseal Joint Systems, Ltd., 2 inch Quietjoint—Concrete to Concrete at Head of Wall, Part No. SHH_2_HW_CONC_INSIDE_CORNER, Mar. 25, 2014, p. 1.
Emseal Joint Systems, Ltd., 2 inch Quietjoint—Gypsum to Concrete at Head of Wall, Part No. SHH_HW_GYP_CONC_INSIDE_CORNER, Mar. 25, 2014, p. 1.
Emseal Joint Systems, Ltd., 2 inch Quietjoint at Wall Partition to Window, Part No. SHG_2_WW_GL_INSIDE_CORNER_WALL_PARTITION_WINDOW, Mar. 25, 2014, p. 1.
Emseal Joint Systems, Ltd., Emshield DFR3 MSDS, last modified Sep. 3, 2014, p. 1.
https://www.google.com/search, seismic colorseal 5130176 "5,130,176", printed on Oct. 12, 2014, p. 1.
http://www.amazon.com, search for emseal U.S. Pat. No. 8,739,495, 1-16 of 624 results for emseal U.S. Pat. No. 8,739,495, printed on Oct. 13, 2014, pp. 1-5.
http://www.amazon.com/QuietJoint-Acoustic-Partition-Closure-2-sided, QuietJoint Acoustic Partition Closure for 3 inch (75mm) Joint, 10 foot (3m), printed on Sep. 29, 2014, pp. 1-3.
http://www.amazon.com/QuietJoint-Acoustic-Partition-Closure-3-sided, QuietJoint Acoustic Partition Closure for 5/8 inch (15 mm) Joint, 10 foot (3m), printed on Oct. 13, 2014, pp. 1-3.
Illbruck, Illmod 2d, Product Information, 2002, pp. 1-2.
Emseal Joint Systems, Ltd., Laminations as a Build Choice—The Anatomy of Quality in Pre-Compressed Foam Sealants, last modified Jul. 30, 2013, pp. 1-3.

(56) References Cited

OTHER PUBLICATIONS

Snapshot of Intent to Issue Ex Parte Reexamination Certificate for U.S. Appl. No. 90/013,395; Oct. 6, 2016, 9 pages.
Snapshot of Intent to Issue Ex Parte Reexamination Certificate for U.S. Appl. No. 90/013,565; Oct. 7, 2016, 9 pages.
Emseal Joint Systems, Lt., Preformed Sealants and Expansion Joint Systems, May 2002, pp. 1-4.
Emseal Joint System, Ltd., Tech Data DSH System, Jan. 2000, pp. 1-2.
Emseal Joint Systems, Ltd., Emseal CAD.dwg, Oct. 2000, pp. 1-7.
Emseal Joint Systems, Ltd., Installation Instructions: AST & IST Sealant Tapes, Dec. 1998, p. 1.
Emseal Joint Systems, Ltd., Emshield WFR2, Fire-Rated Expansion Joint Product Data, Jun. 2009, pp. 1-2.
Emseal Joint System, Ltd., 1/2 Inch Colorseal, Binary Seal System Components, document dated Nov. 24, 1992, p. 1.
Specified Technologies, Inc., Firestop Products for Construction Joint Applications, Copyright 2004 indicated on last page, 20 pages.
Snapshot of Office Action for U.S. Appl. No. 15/589,329; dated Apr. 4, 2019, 11 pages.
Snapshot of Office Action for U.S. Appl. No. 15/633,176; dated Apr. 8, 2019, 15 pages.
Snapshot of Office Action for U.S. Appl. No. 15/681,622; dated Dec. 11, 2018, 14 pages.
Snapshot of Office Action for U.S. Appl. No. 15/494,809; dated Dec. 11, 2018, 11 pages.
Snapshot of Office Action for U.S. Appl. No. 16/115,861; dated Jan. 24, 2019, 5 pages.
Notice of Allowance for U.S. Appl. No. 14/927,047; dated Feb. 6, 2019, 8 pages.
Snapshot of Notice of Allowance for U.S. Appl. No. 14/950,930; dated Apr. 25, 2018, 10 pages.
Snapshot of Notice of Allowance for U.S. Appl. No. 14/950,923; dated May 7, 2018, 10 pages.
Snapshot of Office Action for U.S. Appl. No. 15/494,069; dated Jul. 6, 2018, 14 pages.
Snapshot of Office Action for U.S. Appl. No. 15/494,809; dated Jul. 6, 2018, 6 pages.
Snapshot of Office Action issued in U.S. Appl. No. 90/013,395; dated 2015, 48 pages.
Snapshot of Office Action issued in U.S. Appl. No. 90/013,428; dated 2015, 23 pages.
Snapshot of Office Action issued in U.S. Appl. No. 90/013,472; dated 2015, 22 pages.
Snapshot of Office Action issued in U.S. Appl. No. 90/013,473; dated 2015, 22 pages.
3M; Fire Barrier CP 25WB+Caulk, Product Data Sheet, Copyright 3M 2001, 4 pages.
Tremco Incorporated, "Firestop Submittal" Data Sheet collections, Certificate of Conformance dated Nov. 2004, 47 pages; publication date unknown from document.
Watson Bowman Acme, Wabo Seismic Parking Deck Exp. Joints, Sales Drawing, Feb. 6, 1988, 3 pgs.
Emseal Corp., Horizontal Colorseal Data Sheet, Jun. 1997, 3 pgs.
Emseal Corp., Horizontal Colorseal Beneath Coverplate Product Design Drawing, Oct. 2000, 1 pg.
Emseal Corp., 20H System Data Sheet, Sep. 1996, pp. 1-2.
Watson Bowman Acme, Product Catalog, Feb. 1993, pp. 1-8.
Emseal Joint Systems, Watertight by Design, Buyline 0339, Copyrighted 1996 and marked Jan. 1999, 8 pgs.
Dow Corning, Dow Corning 790 Silicone Building Sealant Data Sheet, Copyrighted 1995, 1999, 6 pgs.
Emseal Joint Systems, Sealing Joints in the Building Envelope: Principles, Products & Practices, Copyright date of 1999, 39 pgs.
Emseal Joint Systems, Product Catalog, Copyright date of 1987, 16 pgs.
Emseal Joint Systems, 20H-Compression Seal Comparison, Apr. 12, 1994, 1 pg.
Emseal Joint Systems, Ltd., Emseal Joint Systems, Marketing Brochure, Jan. 1997, 8 pgs.
City of San Diego, CWP Guidelines, Feb. 1992, pp. 1-13.
Snapshot of Final Office Action for U.S. Appl. No. 90/013,511; dated Feb. 26, 2016, 45 pages.
Snapshot of Advisory Action for U.S. Appl. No. 90/013,472-U.S. Appl. No. 90/013,473; dated Dec. 28, 2015,13 pages.
Snapshot of Non-Final Office Action for U.S. Appl. No. 90/013,428; dated Jan. 5, 2016, 14 pages.
Snapshot of Non-Final Office Action for U.S. Appl. No. 90/013,565; dated Jan. 8, 2016, 20 pages.
Snapshot of Examiner's Interview Summary for U.S. Appl. No. 90/013,511; dated Aug. 26, 2016, 9 pages.
Decision Granting Ex Parte Reexamination on Control No. 90/013,565; Sep. 29, 2015, 19 pages.
Snapshot of Office Action for U.S. Appl. No. 16/243,250; dated Jun. 27, 2019, 25 pages.
Snapshot of Office Action for U.S. Appl. No. 15/681,622; dated Jul. 5, 2019, 14 pages.
Snapshot of Office Action for U.S. Appl. No. 15/589,329; dated Jul. 25, 2019, 9 pages.
Snapshot of Office Action for U.S. Appl. No. 15/633,176; dated Jul. 29, 2019, 12 pages.
Snapshot of Office Action for U.S. Appl. No. 16/115,858; dated Jul. 30, 2019, 7 pages.
Office of Aviation Research, "Polymer Flammability", DOT/FAA/AR-05/14, May 2005, 82 pages, Washington, D.C. 20591.
Snapshot of Office Action for U.S. Appl. No. 15/633,196; dated Aug. 15, 2019, 13 pages.
Snapshot of Office Action for U.S. Appl. No. 15/589,329; dated Nov. 20, 2019, 10 pages.
Snapshot of Office Action for U.S. Appl. No. 15/633,176; dated Nov. 21, 2019, 13 pages.
Snapshot of Office Action for U.S. Appl. No. 16/243,250; dated Jan. 2, 2020, 22 pages.
Snapshot of Office Action for U.S. Appl. No. 15/633,196; dated Jan. 2, 2020, 13 pages.
Snapshot of Office Action for U.S. Appl. No. 15/681,622; dated Jan. 13, 2020, 16 pages.
Snapshot of Office Action for U.S. Appl. No. 15/589,329; dated Jan. 29, 2020, 3 pages.
Snapshot of Office Action for U.S. Appl. No. 15/633,176; dated Jan. 29, 2020, 4 pages.
System No. WW-D-0001, 2000 Fire Resistance Directory, p. 1149, 2000, Underwriters Laboratories, Inc., USA.†
UL 2079 Tests for Fire Resistance of Building Joint Systems, 38 pages, Jun. 30, 2008, Underwriters Laboratories, Inc., Northbrook, Illinois.†
Sealtite "B" Technical Data, Oct. 28, 2005, 2 pages, Scuhl International Co., LLC, USA.†
Pensil PEN300 Silicone Sealant, 4 pages, 2004, Specified Technologies, Inc., USA.†
System No. FF-D-1010, 2000 Fire Resistance Directory, p. 1018, 2000, Underwriters Laboratories, Inc., USA.†
81 Elastic Joint Sealing Tape, 4 pages, Aug. 5, 2005, Adolf Wurth GmbH & Co., KG.†

* cited by examiner
† cited by third party

DETAIL FIG. 1A

FIRE AND/OR WATER RESISTANT EXPANSION JOINT SYSTEM

CROSS REFERENCE TO RELATED APPLICATION

This application is a Continuation Aapplication of U.S. patent application Ser. No. 13/729,500, filed on Dec. 28, 2012, now U.S. Pat. No. 9,670,666, which is a Continuation-in-Part application of U.S. patent application Ser. No. 12/622,574, filed on Nov. 20, 2009, now U.S. Pat. No. 8,365,495, which claims the benefit of U.S. Provisional Patent Application No. 61/116,453, filed on Nov. 20, 2008, the contents of each of which are incorporated herein by reference in their entireties and the benefits of each are fully claimed herein.

TECHNICAL FIELD

The present invention relates generally to joint systems for use in architectural applications and, more particularly, to an expansion joint system for use in building and construction systems.

BACKGROUND

Building and construction applications in which materials such as concrete, metal, and glass are used typically employ joint systems that accommodate thermal and/or seismic movements of the various materials thereof and/or intentional movement of various elements relative to each other. These joint systems may be positioned to extend through both the interior and exterior surfaces (e.g., walls, floors, and roofs) of a building or other structure. In the case of an exterior joint in an exterior wall, roof, or floor exposed to external environmental conditions, the joint system should also, to some degree, resist the effects of such conditions. As such, most exterior joints are designed to resist the effects of water. In particular, vertically-oriented exterior joints are designed to resist water in the form of rain, snow, ice, or debris that is driven by wind. Horizontally-oriented joints are designed to resist water in the form of rain, standing water, snow, ice, debris such as sand, and in some circumstances all of these at the same time. Additionally, some horizontal systems may be subjected to pedestrian and/or vehicular traffic and are designed to withstand such traffic.

In the case of interior joints, water tightness aspects are less of an issue than they are in exterior joints, and so products are often designed simply to accommodate building movement. However, interior horizontal joints may also be subject to pedestrian traffic and in some cases vehicular traffic as well.

It has been generally recognized that building joint systems are deficient with respect to fire resistance. In some instances, movement as a result of building joint systems has been shown to create chimney effects which can have consequences with regard to fire containment. This often results in the subversion of fire resistive elements that may be incorporated into the construction of a building. This problem is particularly severe in large high-rise buildings, parking garages, and stadiums where fire may spread too rapidly to allow the structures to be evacuated.

Early designs for fire resistive joints included monolithic blocks of mineral wool or other inorganic materials of either monolithic or composite constructions either in combination with or without a field-applied liquid sealant. In general, these designs were adequate for non-moving joints or control joints where movements were very small. Where movements were larger and the materials were significantly compressed during the normal thermal expansion cycles of the building structure, these designs generally did not function as intended. Indeed, many designs simply lacked the resilience or recovery characteristics required to maintain adequate coverage of the entire joint width throughout the normal thermal cycle (expansion and contraction) that buildings experience. Many of these designs were tested in accordance with accepted standards such as ASTM E-119, which provides for fire exposure testing of building components under static conditions and does not take into account the dynamic nature of expansion joint systems. As described above, this dynamic behavior can contribute to the compromise of the fire resistance properties of some building designs.

Underwriters Laboratories developed UL 2079, a further refinement of ASTM E-119, by adding a cycling regimen to the test. Additionally, U L 2079 stipulates that the design be tested at the maximum joint size. This test is more reflective of real world conditions, and as such, architects and engineers have begun requesting expansion joint products that meet it. Many designs which pass ASTM E-119 without the cycling regime do not pass UL 2079. This may be adequate, as stated above, for non-moving building joints; however, most building expansion joint systems are designed to accommodate some movement as a result of thermal effects (e.g., expansion into the joint and contraction away from the joint) or as a result of seismic movement.

Both expansion joints and fire resistive expansion joints typically address either the water tightness aspects of the expansion joint system or the fire resistive nature of the expansion joint system, as described above, but not both.

Water resistant or water tight expansion joints exist in many forms, but in general they are constructed from materials designed to resist water penetration during the mechanical cycling caused by movement of the building due to thermal effects. These designs do not have fire resistant properties in a sufficient fashion to meet even the lowest fire rating standards. Indeed, many waterproofing materials act as fuel for any fire present, which can lead to a chimney effect that rapidly spreads fire throughout a building.

Conversely, many fire rated expansion joints do not have sufficient ability to resist water penetration to make them suitable for exterior applications. Many designs reliant upon mineral wool, ceramic materials and blankets, and intumescents, alone or in combination with each other, have compromised fire resistance if they come into contact with water. Additionally, as noted above, many fire rated designs cannot accommodate the mechanical cycling due to thermal effects without compromising the fire resistance.

This has resulted in the installation of two systems for each expansion joint where both a fire rating and water resistance is required. In many cases, there simply is not sufficient room in the physical space occupied by the expansion joint to accommodate both a fire rated system and a waterproofing system. In instances where the physical accommodation can be made, the resultant installation involves two products, with each product requiring its own crew of trained installers. Care is exercised such that one installation does not compromise the other.

Many systems also require on-site assembly to create a finished expansion joint system. This is arguably another weakness, as an incorrectly installed or constructed system may compromise fire and water resistance properties. In some cases, these fire resistant expansion joint systems are invasively anchored to the substrate (which may be concrete). Over time, the points at which such systems are anchored are subject to cracking and ultimately spalling, which may subvert the effectiveness of the fire resistance by simply allowing the fire to go around the fire resistant elements of the system.

Many expansion joint products do not fully consider the irregular nature of building expansion joints. It is quite common for an expansion joint to have several transition areas along its length. These may be walls, parapets, columns or other obstructions. As such, the expansion joint product, in some fashion or other, follows the joint. In many products, this is a point of weakness, as the homogeneous nature of the product is interrupted. Methods of handling these transitions include stitching, gluing, and welding. All of these are weak spots from both a water proofing aspect and a fire resistance aspect.

SUMMARY OF THE INVENTION

As used herein, the term "waterproof" means that the flow of water is prevented, the term "water resistant" means that the flow of water is inhibited, and the term "fire resistant" means that the spread of fire is inhibited.

In one aspect, the present invention resides in a fire resistant and water resistant expansion joint system comprising a core; and a fire retardant infused into the core. The core infused with the fire retardant is configured to define a profile to facilitate compression of the fire and water resistant expansion joint system when installed between substantially coplanar substrates.

In another aspect, the present invention resides in a fire and water resistant architectural joint system comprising first and second substrates arranged to be at least substantially coplanar and an expansion joint located in compression therebetween. The expansion joint comprises a core having a fire retardant infused therein, wherein a layer comprising the fire retardant material is sandwiched between the material of the core, and the core is not coated with any fire retardant material on any outer surface of the core.

In another aspect, the present invention resides in a fire and water resistant architectural joint system comprising first and second substrates arranged to be at least substantially coplanar and an expansion joint located in compression therebetween. The expansion joint comprises a core having a fire retardant infused therein. Upon compression of the expansion joint and its location between the substrates, the expansion joint accommodates movement between the substrates while imparting fire resistance and water resistance.

In another aspect, the present invention resides in a method of installing a fire and water resistant expansion joint. In the method of installing such a joint, first and second substrates are provided in at least a substantially coplanar arrangement such that a gap is formed between the edges thereof. A fire and water resistant expansion joint system comprising a core infused with a fire retardant is compressed and inserted into the gap between the substrates and allowed to expand to fill the gap.

In the embodiments of the systems described herein, the elastomer material, e.g., provides for waterproofing or water resistance, the fire barrier sealants including intumescent materials provide for fire resistance, and the fire retardant infused core provides for both fire and water resistance, and movement properties. The materials and layers described herein can be assembled and arranged in any suitable order/combination to provide the desired fire and water resistant (and/or waterproofing) properties in any desired direction. For example, the materials can be assembled so as to offer waterproofing or water resistance in one direction and fire resistance in the other direction (e.g., an asymmetrical configuration) or, e.g., in a fashion that offers both waterproofing (or water resistance) and fire resistance in both directions (a symmetrical configuration) through the building joint, or any other desired directions/combinations thereof. The system is delivered to the job site in a pre-compressed state ready for installation into the building joint.

The expansion joint systems and architectural joint systems of the present invention provide a substantially resilient fire resistant and water resistant mechanism that is able to accommodate thermal, seismic, and other building movements while maintaining both fire and water resistance characteristics.

DETAILED DESCRIPTION OF THE INVENTION

The expansion joint system described is best understood by referring to the attached drawings. The expansion joint system as described herein is shown as being installed between concrete substrates. The present invention is not limited in this regard, however, as the expansion joint system may be installed between substrates or surfaces other than concrete. Materials for such substrates or surfaces include, but are not limited to, glass, asphalt, stone (granite, marble, etc.), metal, and the like.

Figure 1:
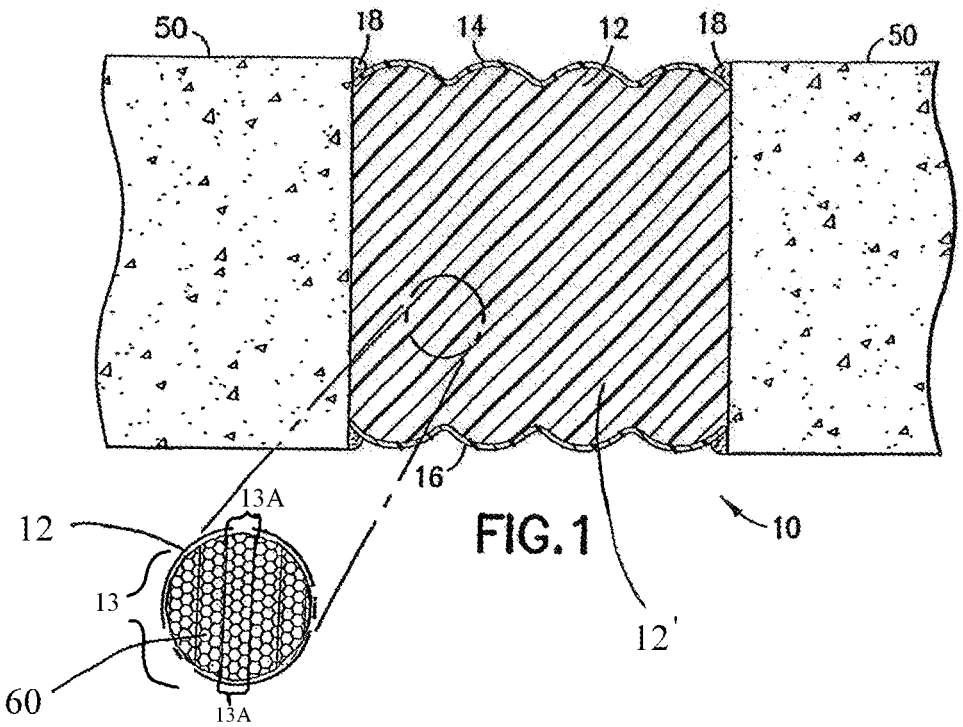
FIG. 1 is a schematic view of one embodiment of an expansion joint system of the present invention.

Referring to FIG. 1, one embodiment of an expansion joint system is shown at 10 and is hereinafter referred to as "system 10." In system 10, a core 12' comprising compressed laminations 13 of open celled polyurethane foam 12 (hereinafter referred to as "foam 12" for ease of reference which is not meant to limit the core 12' to a foam material, but merely illustrate one exemplary material therefore) is infused with a fire retardant material 60 (as illustrated in Detail FIG. 1A) to form the defined expansion joint locatable between coplanar concrete substrates 50. As stated above, the present invention is not limited to the use of polyurethane foams, as other foams are within the scope of the present invention, and other non-foam materials also can be used for the core 12', as explained below. The individual laminations 13A extend substantially perpendicular to the direction in which the joint extends and are constructed by infusing at least one, e.g., an inner lamination with an amount of fire retardant material 60. However, the structures of the present invention are also not limited in this regard as, e.g., the foam 12 and/or core 12' may comprise a solid block of non-laminated foam or other material of fixed size depending upon the desired joint size, a laminate comprising laminations oriented parallel to the direction in which the joint extends, or combinations of the foregoing.

Thus, foam 12 merely illustrates one suitable material for the core 12'. Accordingly, examples of materials for the core 12' include, but are not limited to, foam, e.g., polyurethane foam and/or polyether foam, and can be of an open cell or dense, closed cell construction. Further examples of materials for the core 12' include paper based products, cardboard, metal, plastics, thermoplastics, dense closed cell foam including polyurethane and polyether open or closed cell foam, cross-linked foam, neoprene foam rubber, urethane, ethyl vinyl acetate (EVA), silicone, a core chemistry (e.g., foam chemistry) which inherently imparts hydrophobic and/or fire resistant characteristics to the core; and/or composites. Combinations of any of the foregoing materials or other suitable materials also can be employed. It is further noted that while foam 12 is primarily referred to herein as a material for the core 12', the descriptions for foam 12 also can apply to other materials for the core 12', as explained above.

The core 12' can be infused with a suitable material including, but not limited to, an acrylic, such as a water-based acrylic chemistry, a wax, a fire retardant material, ultraviolet (UV) stabilizers, and/or polymeric materials, combinations thereof, and so forth. A particularly suitable embodiment is a core 12' comprising an open celled foam infused with a water-based acrylic chemistry and/or a fire retardant material.

The amount of fire retardant material 60 infused into the core 12', including the open celled foam embodiment, is between 3.5:1 and 4:1 by weight in ratio with the un-infused foam/core itself, according to embodiments. The resultant uncompressed foam/core, whether comprising a solid block or laminates, has a density of about 130 $kg/m^3$ to about 150 $kg/m^3$ and preferably about 140 $kg/m^3$. Other suitable densities for the resultant core 12' include between about 50 $kg/m^3$ and about 250 $kg/m^3$, e.g., between about 100 $kg/m^3$ and about 180 $kg/m^3$, and which are capable of providing desired water resistance and/or waterproofing characteristics to the structure.

One type of fire retardant material 60 that may be used is water-based aluminum tri-hydrate (also known as aluminum tri-hydroxide (ATH)). The present invention is not limited in this regard, however, as other fire retardant materials may be used. Such materials include, but are not limited to, metal oxides and other metal hydroxides, aluminum oxides, antimony oxides and hydroxides, iron compounds such as ferrocene, molybdenum trioxide, nitrogen-based compounds, phosphorus based compounds, halogen based compounds, halogens, e.g., fluorine, chlorine, bromine, iodine, astatine, combinations of any of the foregoing materials, and other compounds capable of suppressing combustion and smoke formation.

Several laminations of the polyurethane foam or other suitable material, the number depending on the desired size of the expansion joint, are compiled and then compressed and held at such compression in a suitable fixture, according to embodiments. Similarly, a core 12' comprising laminations of non-foam material or comprising a solid block of desired material may be compiled and then compressed and held at such compression in a suitable fixture. The fixture is at a width slightly greater than that which the expansion joint is anticipated to experience at the largest possible movement of the adjacent concrete surfaces. At this width, the infused foam laminate or core 12' is coated with a coating, such as a waterproof elastomer 14 at one surface, according to embodiments. This waterproof elastomer may be a polysulfide, silicone, acrylic, polyurethane, poly-epoxide, silyl-terminated polyether, a formulation of one or more of the foregoing materials with or without other elastomeric components or similar suitable elastomeric coating or liquid sealant materials, or a mixture, blend, or other formulation of one or more of the foregoing. One preferred elastomer coating for application to a horizontal deck where vehicular traffic is expected is Pecora 301, which is a silicone pavement sealant available from Pecora Corporation of Harleysville, Pa. Another preferred elastomeric coating is Dow Corning 888, which is a silicone joint sealant available from Dow Corning Corporation of Midland, Mich. Both of the foregoing elastomers are traffic grade rated sealants. For vertically-oriented expansion joints, exemplary preferred elastomer coatings include Pecora 890, Dow Corning 790, and Dow Corning 795.

Depending on the nature of the adhesive characteristics of the elastomer 14, a primer may be applied to the outer surfaces of the laminations of foam 12 and/or core 12' prior to the coating with the elastomer 14. Applying such a primer may facilitate the adhesion of the elastomer 14 to the foam 12 and/or core 12'.

The elastomer 14 is tooled or otherwise configured to create a "bellows," "bullet," or other suitable profile such that the elastomeric material can be compressed in a uniform and aesthetic fashion while being maintained in a virtually tensionless environment.

The surface of the infused foam laminate and/or core 12' opposite the surface coated with the waterproofing elastomer 14 is coated with an intumescent material 16, according to embodiments. One type of intumescent material 16 may be a caulk having fire barrier properties. A caulk is generally a silicone, polyurethane, polysulfide, sylil-terminated-polyether, or polyurethane and acrylic sealing agent in latex or elastomeric base. Fire barrier properties are generally imparted to a caulk via the incorporation of one or more fire retardant agents. One preferred intumescent material 16 is 3M CP25WB+, which is a fire barrier caulk available from 3M of St. Paul, Minn. Like the elastomer 14, the intumescent material 16 is tooled or otherwise configured to create a "bellows" profile to facilitate the compression of the foam lamination and/or core 12'.

After tooling or otherwise configuring to have the bellows-type of profile, both the coating of the elastomer 14 and the intumescent material 16 are cured in place on the foam 12 and/or core 12' while the infused foam lamination and/or core 12' is held at the prescribed compressed width. After the elastomer 14 and the intumescent material 16 have been cured, the entire composite is removed from the fixture, optionally compressed to less than the nominal size of the material and packaged for shipment to the job site. This first embodiment is suited to horizontal parking deck applications where waterproofing is desired on the top side and fire resistance is desired from beneath, as in the event of a vehicle fire on the parking deck below.

In this system 10, a sealant band and/or corner bead 18 of the elastomer 14 can be applied on the side(s) of the interface between the foam laminate (and/or core 12') and the concrete substrate 50 to create a water tight seal.

Figure 2:
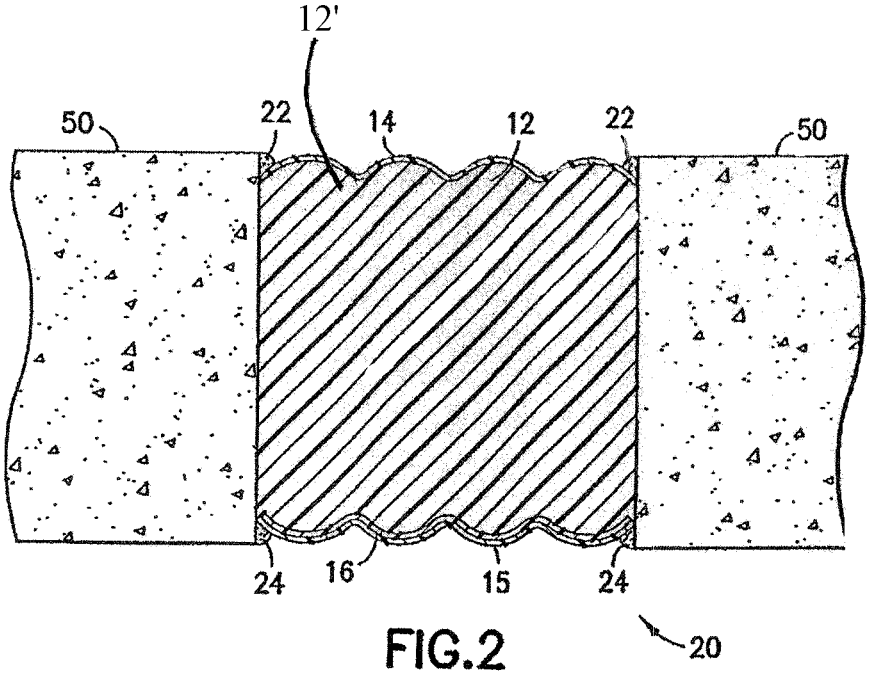
FIG. 2 is a schematic view of another embodiment of an expansion joint system of the present invention.

Referring now to FIG. 2, an alternate expansion joint system 20 of the present invention illustrates the core 12' having a first elastomer 14 coated on one surface and the intumescent material 16 coated on an opposing surface. A second elastomer 15 is coated on the intumescent material 16 and serves the function of waterproofing. In this manner, the system 20 is water resistant in both directions and fire resistant in one direction. The system 20 is used in applications that are similar to the applications in which the system 10 is used, but may be used where water is present on the underside of the expansion joint. Additionally, it would be suitable for vertical expansion joints where waterproofing or water resistance is desirable in both directions while fire resistance is desired in only one direction. The second elastomer 15 may also serve to aesthetically integrate the system 20 with surrounding substrate material.

Sealant bands and/or corner beads 22 of the first elastomer 14 can be applied to the sides as with the embodiment described above. Sealant bands and/or corner beads 24 can be applied on top of the second elastomer 15, thereby creating a water tight seal between the concrete substrate 50 and the intumescent material.

Figure 3:
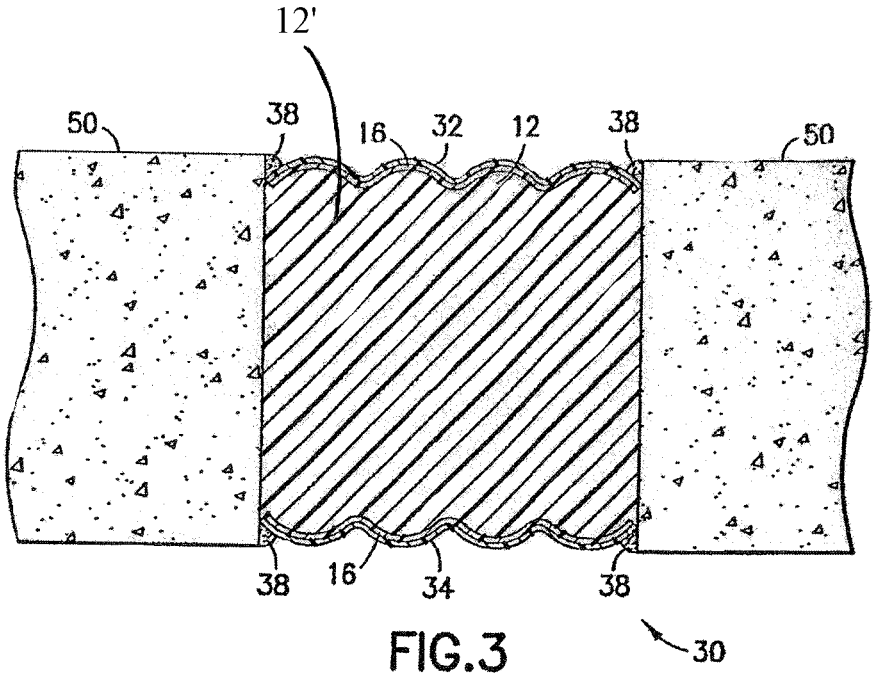
FIG. 3 is a schematic view of another embodiment of an expansion joint system of the present invention.

Referring now to FIG. 3, another expansion joint system of the present invention is shown at 30. In system 30, the foam 12 and/or core 12' is similar to or the same as the above-described foam and/or core 12', but both exposed surfaces are coated first with the intumescent material 16 to define a first coating of the intumescent material and a second coating of the intumescent material 16. The first coating of the intumescent material 16 is coated with a first elastomer material 32, and the second coating of the intumescent material 16 is coated with a second elastomer material 34. This system 30 can be used in the same environments as the above-described systems with the added benefit that it is both waterproof or at least water resistant and fire resistant in both directions through the joint. This makes it especially suitable for vertical joints in either interior or exterior applications.

In system 30, sealant bands and/or corner beads 38 of the elastomer are applied in a similar fashion as described above and on both sides of the foam 12 and/or core 12'. This creates a water tight elastomer layer on both sides of the foam 12 and/or core 12'.

Figure 4:
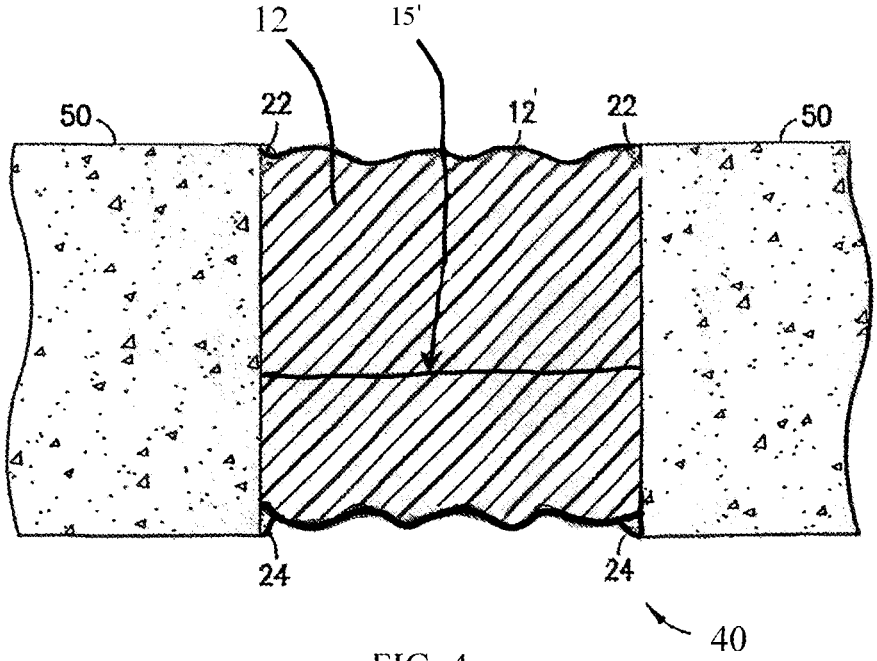
FIG. 4 is a schematic view of a further embodiment of an expansion joint system of the present invention.

Referring now to FIG. 4, shown therein is another expansion joint system 40, according to embodiments. In system 40, the core 12' is infused with a fire retardant material, as described above. As an example, the fire retardant material can form a "sandwich type" construction wherein the fire retardant material forms a layer 15', as shown in FIG. 4, between the material of core 12'. Thus, the layer 15' comprising a fire retardant can be located within the body of the core 12' as, e.g., an inner layer, or lamination infused with a higher ratio or density of fire retardant than the core 12'. It is noted that the term "infused with" as used throughout the descriptions herein is meant to be broadly interpreted to refer to "includes" or "including." Thus, for example, "a core infused with a fire retardant" covers a "core including a fire retardant" in any form and amount, such as a layer, and so forth. Accordingly, as used herein, the term "infused with" would also include, but not be limited to, more particular embodiments such as "permeated" or "filled with" and so forth.

Moreover, it is noted that layer 15' is not limited to the exact location within the core 12' shown in FIG. 4 as the layer 15' may be included at various depths in the core 12' as desired. Moreover, it is further noted that the layer 15' may extend in any direction. For example, layer 15' may be oriented parallel to the direction in which the joint extends, perpendicular to the direction in which the joint extends or combinations of the foregoing. Layer 15' can function as a fire resistant barrier layer within the body of the core 12'. Accordingly, layer 15' can comprise any suitable material providing, e.g., fire barrier properties. No coatings are shown on the outer surfaces of core 12' of FIG. 4.

Accordingly, by tailoring the density as described above to achieve the desired water resistance and/or water proofing properties of the structure, combined with the infused fire retardant in layer 15', or infused within the core 12' in any other desired form including a non-layered form, additional layers, e.g. an additional water and/or fire resistant layer on either or both outer surfaces of the core 12', are not be necessary to achieve a dual functioning water and fire resistant expansion joint system, according to embodiments.

It is noted, however, that additional layers could be employed if desired in the embodiment of FIG. 4, as well as in the other embodiments disclosed herein, and in any suitable combination and order. For example, the layering described above with respect to FIGS. 1, 2 and 3 could be employed in the embodiment of FIG. 4 and/or FIG. 5 described below.

Figure 5:
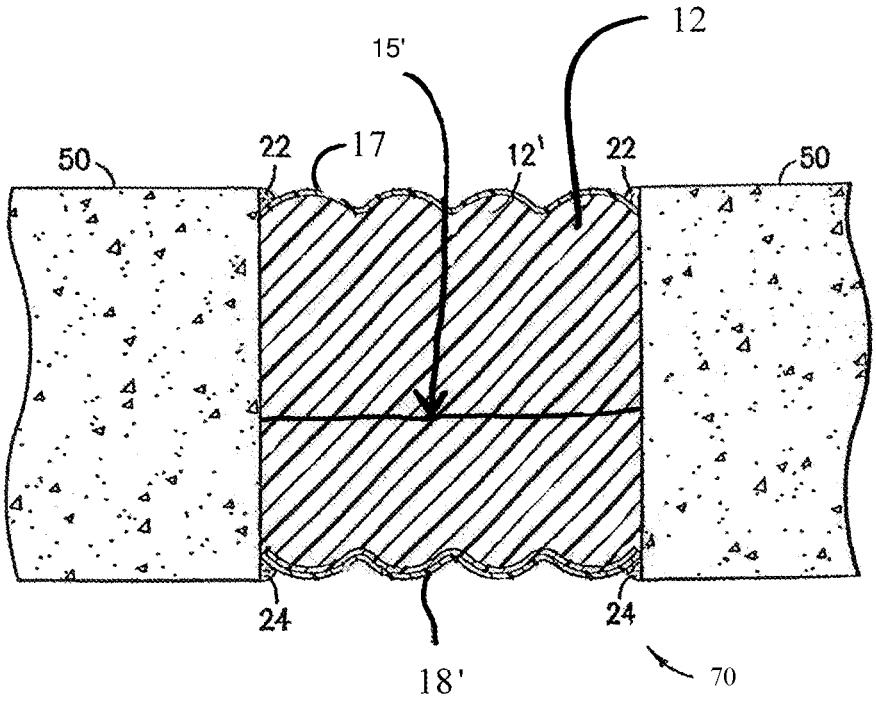
FIG. 5 is another embodiment of an expansion joint system of the present invention.

As a further example, FIG. 5 illustrates therein an expansion joint system 70 comprising the layer 15' comprising a fire retardant within the body of the core 12' as described above with respect to FIG. 4, and also comprising an additional coating 17 on a surface of the core 12'. Coating 17 can comprise any suitable coating, such as the elastomer 14 described above, a fire barrier material including an intumescent material 16 described above or other suitable fire barrier material, e.g., a sealant, a fabric, a blanket, a foil, a tape, e.g., an intumescent tape, a mesh, a glass, e.g., fiberglass; and combinations thereof.

Moreover, embodiments include various combinations of layering and fire retardant infusion (in layer and non-layer form) to achieve, e.g., the dual functioning water and fire resistant expansion joint systems described herein, according to embodiments. For example, FIG. 5 illustrates coating 17 on one surface of the core 12' and a dual coating 18 on the opposite surface of the core 12'. The dual coating 18 can comprise, e.g., an inner layer of elastomer 14, as described above, with an outer layer of a fire barrier material including, e.g., an intumescent material. Similarly, the layers of the dual coating 18 can be reversed to comprise an inner layer of fire barrier material and an outer layer of elastomer 14.

Alternatively, only one layer may be present on either surface of core 12', such as one layer of a fire barrier material, e.g., sealant, on a surface of the core 12', which is infused with a fire retardant material in layer 15' or infused in a non-layer form. Still further, other combinations of suitable layering include, e.g., dual coating 18' on both surfaces of the core 12' and in any combination of inner and outer layers, as described above.

It is additionally noted that the embodiments shown in FIGS. 4 and 5 can be similarly constructed, as described above with respect to, e.g., the embodiments of FIGS. 1-3, modified as appropriate for inclusion/deletion of various layering, and so forth. Thus, for example, as described above, while a "bellows" construction is illustrated by the figures, the embodiments described herein are not limited to such a profile as other suitable profiles may be employed, such as straight, curved, and so forth.

Accordingly, as further evident from the foregoing, embodiments of the dual functioning fire and water resistant expansion joint systems can comprise various ordering and layering of materials on the outer surfaces of the core 12'. Similarly, a fire retardant material can be infused into the core 12' in various forms, to create, e.g., a layered "sandwich type" construction with use of, e.g., layer 15'.

In the embodiments described herein, the infused foam laminate and/or core 12' may be constructed in a manner which insures that substantially the same density of fire retardant 60 is present in the product regardless of the final size of the product, according to embodiments. The starting density of the infused foam/core is approximately 140 $kg/m^3$, according to embodiments. Other suitable densities include between about 80 kg/m$^3$ and about 180 kg/m$^3$. After compression, the infused foam/core density is in the range of about 160-800 kg/m$^3$, according to embodiments. After installation the laminate and/or core 12' will typically cycle between densities of approximately 750 kg/m$^3$ at the smallest size of the expansion joint to approximately 360-450 kg/m$^3$, e.g., approximately 400-450 kg/m$^3$ (or less) at the maximum size of the joint. A density of 400-450 kg/m$^3$ was determined through experimentation, as a reasonable value which still affords adequate fire retardant capacity, such that the resultant composite expansion joint can pass the UL 2079 test program. Embodiments of the expansion joint system of the present invention are not limited to cycling in the foregoing ranges, e.g., the foam/core may attain densities outside of the herein-described ranges and still pass the UL 2079 test program.

In horizontal expansion joint systems, installation is accomplished by adhering the foam laminate and/or core 12' to the concrete substrate using an adhesive such as epoxy, according to embodiments. The epoxy or other adhesive is applied to the faces of the expansion joint prior to removing the foam laminate and/or core 12' from the packaging thereof (such packaging may comprise restraining elements, straps, ties, bands, shrink wrap plastic, or the like). Once the packaging has been removed, the foam laminate and/or core 12' will begin to expand, and it should be inserted into the joint in the desired orientation further to the application of epoxy or other adhesive materials to the side(s) of the foam laminate and/or core 12' if so desired. Once the foam lamination and/or core 12' has expanded to suit the expansion joint, it will become locked in by the combination of the foam back pressure and the adhesive.

In vertical expansion joint systems, an adhesive band may be pre-applied to the foam lamination and/or core 12'. In this case, for installation, the foam laminate and/or core 12' is removed from the packaging and simply inserted into the space between the concrete surfaces to be joined where it is allowed to expand to meet the concrete substrate. Once this is done, the adhesive band in combination with the back pressure of the foam 12 and/or core 12' will hold the foam 12 and/or core 12' in position.

To fill an entire expansion joint, the installation as described above is repeated as needed. To join the end of one foam laminate and/or core 12' to the end of another in either the horizontal configuration or the vertical configuration, a technique similar to that used with the sealant band and/or corner beads can be employed. After inserting one section of a system (joint) and adhering it securely to the concrete substrate, the next section is readied by placing it in proximity to the first section. A band or bead of the intumescent material and the elastomer material is applied on the end of the foam laminate in the appropriate locations. The next section is removed from the packaging and allowed to expand in close proximity to the previously installed section. When the expansion has taken place and the section is beginning to adhere to the substrates (joint faces), the section is firmly seated against the previously installed section. The outside faces are then tooled to create an aesthetically pleasing seamless interface.

The above mentioned installation procedure is simple, rapid, and has no invasive elements which impinge upon or penetrate the concrete (or other) substrates. This avoids many of the long term problems associated with invasive anchoring of screws into expansion joint faces.

Thus, according to embodiments of the invention disclosed is an expansion joint system. The expansion joint system comprises: a core; and a fire retardant included in the core in an amount effective to pass testing mandated by UL 2079; wherein the core with the fire retardant is configured to facilitate compression of the expansion joint system when installed between substrates by repeatedly expanding and contracting to accommodate movement of the substrates; and the core with the fire retardant included therein is configured to pass the testing mandated by UL 2079. According to aspects of the invention, i) the core with the fire retardant included therein has a density when compressed of about 160 kg/m$^3$ to about 800 kg/m$^3$; and/or ii) a layer comprising the fire retardant is sandwiched between the material of the core; and/or iii) an additional material is included in the core and is selected from the group consisting of an acrylic, a wax, an ultraviolet stabilizer, a polymeric material, and combinations of the foregoing materials; and/or iv) the fire retardant included in the core is selected from the group consisting of water-based aluminum tri-hydrate, metal oxides, metal hydroxides, aluminum oxides, antimony oxides and hydroxides, iron compounds, ferrocene, molybdenum trioxide, nitrogen-containing compounds, phosphorus based compounds, halogen based compounds, halogens, and combinations of the foregoing materials; and/or v) a water resistant layer is disposed on a surface of the core; and/or vi) the water resistant layer is adhesively disposed on the surface of the core and is selected from the group consisting of silicone, polysulfides, acrylics, polyurethanes, poly-epoxides, silyl-terminated polyethers, and combinations of one or more of the foregoing; and/or vii) comprises a fire barrier sealant layer; and/or viii) comprises a layer comprising a caulk; and/or ix) the core uncompressed has a density of about 50 kg/m$^3$ to about 250 kg/m$^3$; and/or x) further comprises a second layer disposed beneath the water resistant layer, wherein the second layer is selected from the group consisting of another water resistant layer, a fire barrier sealant layer, and combinations thereof; and/or xi) a first coating is located on a surface of the core, and a second coating is located on a surface of the core opposing the first coating, wherein the first coating is the substantially the same as or different than the second coating; and/or xii) at least one of the first coating and the second coating comprises a dual coating; and/or xiii) the core is selected from the group consisting of foam, a paper based product, metal, plastic, thermoplastic, and combinations thereof; and/or xiv) the core comprises at least one of polyurethane foam, polyether foam, open cell foam, dense closed cell foam, cross-linked foam, neoprene foam rubber, urethane, cardboard, and a composite; and/or xv) the core is selected from the group consisting of a plurality of laminations, a solid block, and combinations thereof; and/or xvi) the core comprises a plurality of laminations, at least one of the laminations is with the fire retardant included therein; and/or xvii) the lamination with the fire retardant included therein is an inner lamination of the plurality of laminations; and/or xviii) the laminations are oriented, with respect to the direction in which the joint extends in its width, in at least one of a parallel orientation, a perpendicular orientation, and a combination thereof; and/or xix) the expansion joint system is capable of withstanding exposure to a temperature of about 540° C. at about five minutes; and/or xx) the expansion joint system is capable of withstanding exposure to a temperature of about 930° C. at about one hour; and/or xxi) the expansion joint system is capable of withstanding exposure to a temperature of about 1010° C. at about two hours; and/or xxii) the expansion joint system is capable of withstanding exposure to a temperature of about 1052° C. at about three hours; and/or xxiii) the expansion joint system is capable of withstanding exposure to a temperature of about 1093° C. at about four hours; and/or xxiv) the expansion joint system is capable of withstanding exposure to a temperature of about 1260° C. at about eight hours; and/or xxv) the fire retardant is permeated throughout the core in an amount effective to pass testing mandated by UL 2079; and/or xxvi) the core with the fire retardant included therein when installed cycles and attains a density outside of about 160 kg/m$^3$ to about 800 kg/m$^3$.

According to further embodiments of the invention, disclosed is an architectural joint system. The system comprises: a first substrate; a second substrate; and an expansion joint located between the first substrate and the second substrate. The expansion joint comprises: a core having a fire retardant therein in an amount effective to pass testing mandated by UL 2079, wherein the expansion joint is configured to facilitate compression when installed between the first substrate and the second substrate by repeatedly expanding and contracting to accommodate movement therebetween; and the core with the fire retardant included therein is configured to pass the testing mandated by UL 2079. According to aspects of the invention, i) the core with the fire retardant included therein has a density when compressed of about 160 kg/m$^3$ to about 800 kg/m$^3$; and/or ii) a layer comprising the fire retardant is sandwiched between the material of the core; and/or iii) and/or an additional material is included in the core and is selected from the group consisting of an acrylic, a wax, an ultraviolet stabilizer, a polymeric material and combinations of the foregoing materials; and/or iv) the fire retardant infused into the core is selected from the group consisting of water-based aluminum tri-hydrate, metal oxides, metal hydroxides, aluminum oxides, antimony oxides and hydroxides, iron compounds, ferrocene, molybdenum trioxide, nitrogen-containing compounds, and combinations of the foregoing materials; and/or v) the core uncompressed has a density of about 50 kg/m$^3$ to about 250 kg/m$^3$; and/or vi) the core with the fire retardant included therein when installed cycles and attains a density outside of about 160 kg/m$^3$ to about 800 kg/m$^3$; and/or vii) further comprises a fire barrier sealant layer; and/or viii) the system is capable of withstanding exposure to a temperature of about 540° C. at about five minutes; and/or ix) the system is capable of withstanding exposure to a temperature of about 930° C. at about one hour; and/or x) the system is capable of withstanding exposure to a temperature of about 1010° C. at about two hours; and/or xi) the system is capable of withstanding exposure to a temperature of about 1052° C. at about three hours; and/or xii) the system is capable of withstanding exposure to a temperature of about 1093° C. at about four hours; and/or xiii) the system is capable of withstanding exposure to a temperature of about 1260° C. at about eight hours; and/or xiv) the fire retardant is permeated throughout the core in an amount effective to pass testing mandated by UL 2079.

According to further embodiments of the invention, disclosed is an architectural expansion joint system. The system comprises: a first substrate; a second substrate; and an expansion joint located between the first substrate and the second substrate. The expansion joint comprises: a core having a fire retardant included therein in an amount effective to pass testing mandated by UL 2079, and wherein a layer comprising the fire retardant is sandwiched between the material of the core, wherein the expansion joint is configured to facilitate compression of the system when installed between the first substrate and the second substrate by repeatedly expanding and contracting to accommodate movement therebetween; and the core with the fire retardant included therein is configured to pass the testing mandated by UL 2079. According to aspects of the invention, i) a method of installing an expansion joint system utilizing the afore-referenced expansion joint system comprises: providing a first substrate of the substrates; providing a second substrate of the substrates being spaced from the first substrate by a gap; inserting the expansion joint system into the gap between the first substrate and the second substrate; and allowing the compressed expansion joint system to decompress to fill the gap between the first substrate and the second substrate; and/or ii) a layer comprising the fire retardant is sandwiched between the material of the core; and/or iii) the layer comprising the fire retardant is sandwiched between the material of the core and is oriented, with respect to the direction in which the joint extends in its width, in at least one of a parallel orientation, a perpendicular orientation, and a combination thereof; and/or iv) the system is capable of withstanding exposure to a temperature of about 540° C. at about five minutes; and/or v) the system is capable of withstanding exposure to a temperature of about 930° C. at about one hour; and/or vi) the system is capable of withstanding exposure to a temperature of about 1010° C. at about two hours; and/or vii) the system is capable of withstanding exposure to a temperature of about 1052° C. at about three hours; and/or viii) the system is capable of withstanding exposure to a temperature of about 1093° C. at about four hours; and/or ix) the system is capable of withstanding exposure to a temperature of about 1260° C. at about eight hours; and/or x) the fire retardant is permeated throughout the core in an amount effective to pass testing mandated by UL 2079; and/or xi) the core with the fire retardant included therein when installed cycles and attains a density outside of about 160 kg/m$^3$ to about 800 kg/m$^3$.

It is further noted that the various embodiments, including constructions, layering and so forth described herein, can be combined in any combination and in any order to result in, e.g., a dual functioning water and fire resistant expansion joint system. Thus, the embodiments described herein are not limited to the specific construction of the figures, as the various materials, layering and so forth described herein can be combined in any desired combination and order.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An expansion joint system, comprising:

a core; and a fire retardant included in the core, the core with the fire retardant therein configured to have a compressed density effective to pass testing as provided by UL 2079;

wherein the core with the fire retardant therein is configured to facilitate compression of the expansion joint system between substrates by repeatedly expanding and contracting to accommodate movement of the substrates; and wherein the core with the fire retardant therein is configured to withstand exposure to a temperature of about 540° C. at about five minutes.

2. The expansion joint system of claim 1, wherein the core with the fire retardant included therein has a density when compressed of about 160 kg/m$^3$ to about 800 kg/m$^3$.

3. The expansion joint system of claim 1, wherein a layer comprising the fire retardant is disposed in the core.

4. The expansion joint system of claim 1, wherein an additional material is included in the core and is selected from the group consisting of an acrylic, a wax, an ultraviolet stabilizer, a polymeric material, and combinations of the foregoing materials.

5. The expansion joint system of claim 1, wherein the fire retardant included in the core is selected from the group consisting of water-based aluminum tri-hydrate, metal oxides, metal hydroxides, aluminum oxides, antimony oxides and hydroxides, iron compounds, ferrocene, molybdenum trioxide, nitrogen-containing compounds, phosphorus based compounds, halogen based compounds, halogens, and combinations of the foregoing materials.

6. The expansion joint system of claim 1, wherein a water resistant layer is disposed on a surface of the core.

7. The expansion joint system of claim 6, wherein the water resistant layer is adhesively disposed on the surface of the core and is selected from the group consisting of silicone, polysulfides, acrylics, polyurethanes, poly-epoxides, silyl-terminated polyethers, and combinations of one or more of the foregoing.

8. The expansion joint system of claim 6, further comprising a second layer disposed beneath the water resistant layer, wherein the second layer is selected from the group consisting of another water resistant layer, a fire barrier sealant layer, and combinations thereof.

9. The expansion joint system of claim 1, comprising a fire barrier sealant layer.

10. The expansion joint system of claim 1, comprising a layer comprising a caulk.

11. The expansion joint system of claim 1, wherein the core uncompressed has a density of about 50 kg/m$^3$ to about 250 kg/m$^3$.

12. The expansion joint system of claim 1, wherein a first coating is located on a surface of the core, and a second coating is located on a surface of the core opposing the first coating, wherein the first coating is the substantially the same as or different than the second coating.

13. The expansion joint system of claim 12, wherein at least one of the first coating and the second coating comprises a dual coating.

14. The expansion joint system of claim 1, wherein the core is selected from the group consisting of foam, a paper based product, metal, plastic, thermoplastic, and combinations thereof.

15. The expansion joint system of claim 1, wherein the core comprises at least one of polyurethane foam, polyether foam, open cell foam, dense closed cell foam, cross-linked foam, neoprene foam rubber, urethane, cardboard, and a composite.

16. The expansion joint system of claim 1, wherein the core is selected from the group consisting of a plurality of laminations, a solid block, and combinations thereof.

17. The expansion joint system of claim 1, wherein the core comprises a plurality of laminations, at least one of the laminations is with the fire retardant included therein.

18. The expansion joint system of claim 17, wherein the lamination with the fire retardant included therein is an inner lamination of the plurality of laminations.

19. The expansion joint system of claim 17, wherein the laminations are oriented, with respect to the direction in which the joint extends in its width, in at least one of a parallel orientation, a perpendicular orientation, and a combination thereof.

20. The expansion joint system of claim 1, wherein the expansion joint system is capable of withstanding exposure to a temperature of about 930° C. at about one hour.

21. The expansion joint system of claim 1, wherein the expansion joint system is capable of withstanding exposure to a temperature of about 1010° C. at about two hours.

22. The expansion joint system of claim 1, wherein the expansion joint system is capable of withstanding exposure to a temperature of about 1052° C. at about three hours.

23. The expansion joint system of claim 1, wherein the expansion joint system is capable of withstanding exposure to a temperature of about 1093° C. at about four hours.

24. The expansion joint system of claim 1, wherein the expansion joint system is capable of withstanding exposure to a temperature of about 1260° C. at about eight hours.

25. The expansion joint system of claim 1, wherein the fire retardant is permeated throughout the core, the core with the fire retardant permeated throughout configured to have a compressed density effective to pass the testing as provided by UL 2079.

26. The expansion joint system of claim 1, wherein the core with the fire retardant included therein cycles and attains a density outside of about 160 kg/m$^3$ to about 800 kg/m$^3$.

27. An architectural joint system, comprising:

a first substrate;

a second substrate; and an expansion joint located between the first substrate and the second substrate, the expansion joint comprising:

a core having a fire retardant therein, the core with the fire retardant therein configured to have a compressed density effective to pass testing as provided by UL 2079;

wherein the core with the fire retardant therein is configured to withstand exposure to a temperature of about 540° C. at about five minutes; and wherein the expansion joint is configured to facilitate compression between the first substrate and the second substrate by repeatedly expanding and contracting to accommodate movement therebetween.

28. The architectural joint system of claim 27, wherein the core with the fire retardant included therein has a density when compressed of about 160 kg/m$^3$ to about 800 kg/m$^3$.

29. The architectural joint system of claim 27, wherein a layer comprising the fire retardant is disposed in the core.

30. The architectural joint system of claim 27, wherein an additional material is included in the core and is selected from the group consisting of an acrylic, a wax, an ultraviolet stabilizer, a polymeric material and combinations of the foregoing materials.

31. The architectural joint system of claim 27, wherein the fire retardant included in the core is selected from the group consisting of water-based aluminum tri-hydrate, metal oxides, metal hydroxides, aluminum oxides, antimony oxides and hydroxides, iron compounds, ferrocene, molybdenum trioxide, nitrogen-containing compounds, and combinations of the foregoing materials.

32. The architectural joint system of claim 27, wherein the core uncompressed has a density of about 50 kg/m$^3$ to about 250 kg/m$^3$.

33. The architectural joint system of claim 27, wherein the core with the fire retardant included therein when located between the first substrate and the second substrate cycles and attains a compressed density outside of about 160 kg/m$^3$ to about 800 kg/m$^3$.

34. The architectural joint system of claim 27, further comprising a fire barrier sealant layer.

35. The architectural joint system of claim 27, wherein the system is capable of withstanding exposure to a temperature of about 930° C. at about one hour.

36. The architectural joint system of claim 27, wherein the system is capable of withstanding exposure to a temperature of about 1010° C. at about two hours.

37. The architectural joint system of claim 27, wherein the system is capable of withstanding exposure to a temperature of about 1052° C. at about three hours.

38. The architectural joint system of claim 27, wherein the system is capable of withstanding exposure to a temperature of about 1093° C. at about four hours.

39. The architectural joint system of claim 27, wherein the system is capable of withstanding exposure to a temperature of about 1260° C. at about eight hours.

40. The architectural joint system of claim 27, wherein the fire retardant is permeated throughout the core, the core with the fire retardant permeated throughout configured to have a compressed density effective to pass the testing as provided by UL 2079.

41. An architectural expansion joint system, comprising:
- a first substrate;
- a second substrate; and
- an expansion joint located between the first substrate and the second substrate, the expansion joint comprising:
  - a core having a fire retardant included therein, the core with the fire retardant therein configured to have a compressed density effective to pass testing as provided by UL 2079;
  - wherein the core with the fire retardant therein is configured to withstand exposure to a temperature of about 540° C. at about five minutes; and
  - wherein a layer comprising the fire retardant is disposed in the core, wherein the expansion joint is configured to facilitate compression of the system between the first substrate and the second substrate by repeatedly expanding and contracting to accommodate movement therebetween.

42. The architectural expansion joint system of claim 41, wherein the system is capable of withstanding exposure to a temperature of about 930° C. at about one hour.

43. The architectural expansion joint system of claim 41, wherein the system is capable of withstanding exposure to a temperature of about 1010° C. at about two hours.

44. The architectural expansion joint system of claim 41, wherein the system is capable of withstanding exposure to a temperature of about 1052° C. at about three hours.

45. The architectural expansion joint system of claim 41, wherein the system is capable of withstanding exposure to a temperature of about 1093° C. at about four hours.

46. The architectural expansion joint system of claim 41, wherein the system is capable of withstanding exposure to a temperature of about 1260° C. at about eight hours.

47. The architectural expansion joint system of claim 41, wherein the fire retardant is permeated throughout the core, the core with the fire retardant permeated throughout configured to have a compressed density effective to pass the testing as provided by UL 2079.

48. The architectural expansion joint system of claim 41, wherein the core with the fire retardant included therein cycles and attains a density outside of about 160 kg/m$^3$ to about 800 kg/m$^3$.

49. The architectural joint system of claim 41, wherein the core uncompressed has a density of about 50 kg/m$^3$ to about 250 kg/m$^3$.

50. The architectural joint system of claim 41, wherein the core with the fire retardant included therein has a compressed density of about 160 kg/m$^3$ to about 800 kg/m$^3$.

51. A method of installing an expansion joint system utilizing the expansion joint system of claim 1, comprising:
- providing a first substrate of the substrates;
- providing a second substrate of the substrates being spaced from the first substrate by a gap;
- inserting the expansion joint system into the gap between the first substrate and the second substrate; and
- allowing the compressed expansion joint system to decompress to fill the gap between the first substrate and the second substrate.

52. The method of claim 51, wherein a layer comprising the fire retardant is disposed in the core.

53. The method of claim 52, wherein the layer comprising the fire retardant is disposed in the core and is oriented, with respect to the direction in which the joint extends in its width, in at least one of a parallel orientation, a perpendicular orientation, and a combination thereof.

54. The method of claim 51, wherein the core uncompressed has a density of about 50 kg/m$^3$ to about 250 kg/m$^3$.

55. The method of claim 51, wherein the core with the fire retardant included therein has a compressed density of about 160 kg/m$^3$ to about 800 kg/m$^3$.

* * * * *